United States Patent [19]

Titchener et al.

[11] Patent Number: 4,770,034

[45] Date of Patent: Sep. 13, 1988

[54] METHOD AND APPARATUS FOR DATA TRANSMISSION IN A WELL BORE CONTAINING A CONDUCTIVE FLUID

[75] Inventors: Paul F. Titchener, Menlo Park; Michael J. M. Walsh, Kentwood, both of Calif.

[73] Assignee: Comdisco Resources, Inc., San Francisco, Calif.

[21] Appl. No.: 934,610

[22] Filed: Oct. 9, 1986

Related U.S. Application Data

[63] Continuation-in-part of Ser. No. 700,352, Feb. 11, 1985, abandoned.

[51] Int. Cl.[4] ..... E21B 47/12

[52] U.S. Cl. ..... 73/151; 340/857

[58] Field of Search ..... 367/83, 81; 73/155, 73/152, 151; 340/856, 857, 858, 859; 324/351, 353

[56] References Cited

U.S. PATENT DOCUMENTS 2,172,625 9/1939 Schlumberger ..... 324/366

*Primary Examiner*—Jerry W. Myracle

*Attorney, Agent, or Firm*—Christie, Parker & Hale

[57] ABSTRACT

Method and an arrangement are disclosed for recovery of data signals representing a parameter from down hole to the top of a well bore (20*a*). The well bore has conductive fluid (54,60) and the data signals represent a parameter down hole in the well bore. An exposed electrode receiver (34) is lowered in the well bore suspended from a flexible line (36) while the line extends to the top of the well bore. Electrical potentials representing the parameters are received by the receiver from the conductive fluid. Data signals representing the parameter represented by the received potentials are passed over the flexible line to the top of the well bore.

50 Claims, 16 Drawing Sheets

40
20
38
PROCESSING
DISPLAY/STORAGE
22
58
56
54
42
63
26a
46
21
24
20a
60
52
26
36
26b
34
26c
28
32
50
26d
30
48
44
54

40
20
38
PROCESSING
DISPLAY/STORAGE
58
56
22
54
42
63
26a
46
21
24
52
60
26
36
26b
34
26c
28
30'
50
48
44

40
20
38
PROCESSING
DISPLAY/STORAGE
22
58
56
54
42
63
46
24
26a
21
60
52
26
36
26b
34
26c
28
30'''
48
44

40
20
38
PROCESSING
DISPLAY/STORAGE
58
56
22
54
42
63
26a
46
21
24
60
52
26
36
26b
34
26c
50
48
44
28"
31
30"

26
21
24
46
36
26d
26c
34'
60
81
84
28'
80
82
30'
79
26c"
26c'
50
48

26c' 26c
21
26
60
36
200
86
50
34'
24
46
86
48
94a
104
94
106
92
90
96
92a
i
98
100
102
108

METHOD AND APPARATUS FOR DATA TRANSMISSION IN A WELL BORE CONTAINING A CONDUCTIVE FLUID

CROSS REFERENCES

The patent applications whose titles, serial numbers and filing dates are noted below have the same inventors as the present patent application and disclose subject matter which is common to the present patent application: Telemetry System Using an Antenna, U.S. Ser. No. 700,352, of which this application is a continuation-in-part, filed Feb. 11, 1985, now abandoned priority of which is claimed herein; Method and Means for Obtaining Data Representing a Parameter of Fluid Flowing Through a Down Hole Side of an Oil or Gas Well Bore, filed Oct. 9, 1986, under Ser. No. 918,252, and claiming priority of said U.S. Ser. No. 700,352; and Method and Apparatus for Data Transmission in a Well using a Flexible Line with Stiffener, filed Oct. 7, 2987, under Ser. No. 109,306.

FIELD OF THE INVENTION

This invention relates to method and apparatus for communicating data between a down hole location in a well and a top portion of the well.

BACKGROUND OF THE INVENTION

There are many stages in the lifetime of oil or gas wells at which physical parameters down in the well should be known to the operators at the surface of the well. During initial drilling of the well, parameters such as azimuth and direction are important. During completion of the well, parameters such as pressure may be monitored down hole while a particular tool is being used. During production, it is desirable to monitor the temperature or pressure down hole.

Oil and gas wells are also known having a well bore for passing fluid, transversely across a side of the well bore at a down hole location of the well bore and longitudinally in the well bore, between a geological formation located at the down hole location and a top portion of the well bore. The pressure of the fluid flowing across the side of the well is an important parameter to know by operators at the top of the well. Other parameters of the fluid as it flows across the side of the well may also be important to know at the top of the well. For example, during fracturing, when fluid is passed into the geological formation, pressure at the down hole location is important in determining whether a fracture is vertical or horizontal and to determine growth parameters of the fracture. Fluid pressure and temperature at the down hole location of a producing well, where fluid is flowing from the geological formation to the top of the well, may also be important in some situations. However, remoteness of the down hole location from the top of the well, high flow rates of the fracture fluid across the side of the well and the harsh environment down hole create difficulties in reliably recovering data representing the pressure and other parameters from the fluid at the down hole location.

Therefore, a need exists for easy to use apparatus and methods for recovery, at the top of a well bore, data which accurately and reliably represents a parameter, particularly pressure, of a fluid and particularly a fracture fluid, as that parameter exists in the fluid flowing through the side of the well at the down hole location.

SUMMARY OF THE INVENTION

Briefly, an embodiment of the present invention is a method or means for recovery of data signals from down hole up to the top of the well bore, which has a conductive fluid therein. The data signals represent a parameter down hole in the well bore. The method can be summarized as follows.

An exposed electrode receiver is lowered down the well bore suspended at the end of a flexible line, preferably a wire line, while the line extends to the top of the well bore. Electrical potentials representing the parameter are received by the receiver from the conductive fluid. Data signals representing the parameter represented by the received potentials are passed up to the top of the well bore over a flexible line.

Preferably, the flexible line comprises at least one insulated conductor over which the data signals are conducted to the top of the well bore and a metal sheath therearound from which the receiver is suspended.

In one arrangement, a sensor and a transmitter are lowered down inside the well bore. The electrode receiver is lowered down hole inside of the well bore separately from the sensor and transmitter. Electrical potentials representing a parameter sensed by the sensor are created with the transmitter and received with the receiver in the conductive fluid in contact with the electrode receiver.

Preferably, the sensor senses pressure in the well bore.

With one arrangement, the potentials are formed with a coil.

The potentials may be formed by inducing currents along the length of an elongated member.

The transmitter, in one arrangement, forms variable frequency potentials representative of the parameter. Preferably, the transmitter forms digitally coded potentials representative of the parameter.

In one embodiment, the data signals are amplified at the top of the well bore. In a preferred arrangement, the data signals are preamplified before being passed or conducted up to the top of the well bore.

In one arrangement, the flexible line has a further conductor, as well as the insulated conductor, extending to the top of the well bore and the receiver comprises means for forming the data signals conducted to the top of the well bore on the at least one conductor and the further conductor.

Preferably, the electrode receiver is substantially 5 feet in length or longer and preferably has a diameter of about 0.5 inches.

In one arrangement, the receiver has first and second spaced apart electrodes exposed to the conductive fluid and signals corresponding to the potentials received by the electrodes are formed on the at least one conductor and the further conductor for conduction to the top of the well bore.

Preferably, the flexible line is a wire line which has a metal sheath and the receiver is mechanically connected to and supported by the metal sheath and is electrically coupled to the insulated conductor.

A number of advantages can be achieved by the present invention. For example, it is possible to position the receiver after the casing is set. Additionally, the receiver can be lowered on the flexible line to a position closely adjacent to the transmitter. It is unnecessary to preattach the receiver to casing or the like. Additionally, there need not be any obstruction to the flow of fluid when tubing is placed in the well as the receiver and its flexible line can be positioned in the annulus between the tubing and the casing.

Also placing the flexible line in the annulus and passing the fracturing fluid down the tubing string minimizes any downward pull or drag on the flexible line that otherwise would be present if the fracturing fluid flows in contact with the wire line.

With arrangements where there is a tubing string inside of the well bore, it is desirable to make the tubing string as large in diameter as possible, relative to the inside of the well bore causing the annulus spacing to be quite small, leaving very little room for passing parts on a flexible line down the well. Since a receiver can be made quite small, by mounting only the receiver on a flexible line it is possible to pass or feed the line down the annulus. Minimizing the obstruction to the flexible line in the annulus by minimizing the parts hung on the line as it is passed down the annulus is, therefore, very important. The larger parts, such as the transmitter, sensor and the battery supply for the transmitter and receiver, are separated from the receiver and flexible line and are either mounted on the tubing string as it is and lowered or can be dropped (i.e. air mailed) down the hole in a common module to the desired position for sensing. If the transmitter, sensor and battery are air mailed, this can be done down the inside of the tubing string or down the casing prior to insertion of the tubing. Summarizing, the transmitter sensor and battery are lowered to the position for sensing and the receiver is suspended on the flexible line and the flexbile line and receiver are lowered together down the annulus to a close enough position relative to the position of the transmitter that the receiver can receive the data signals transmitted by the transmitter.

DETAILED DESCRIPTION OF THE PREFERRED EMBODIMENTS

Figure 1:
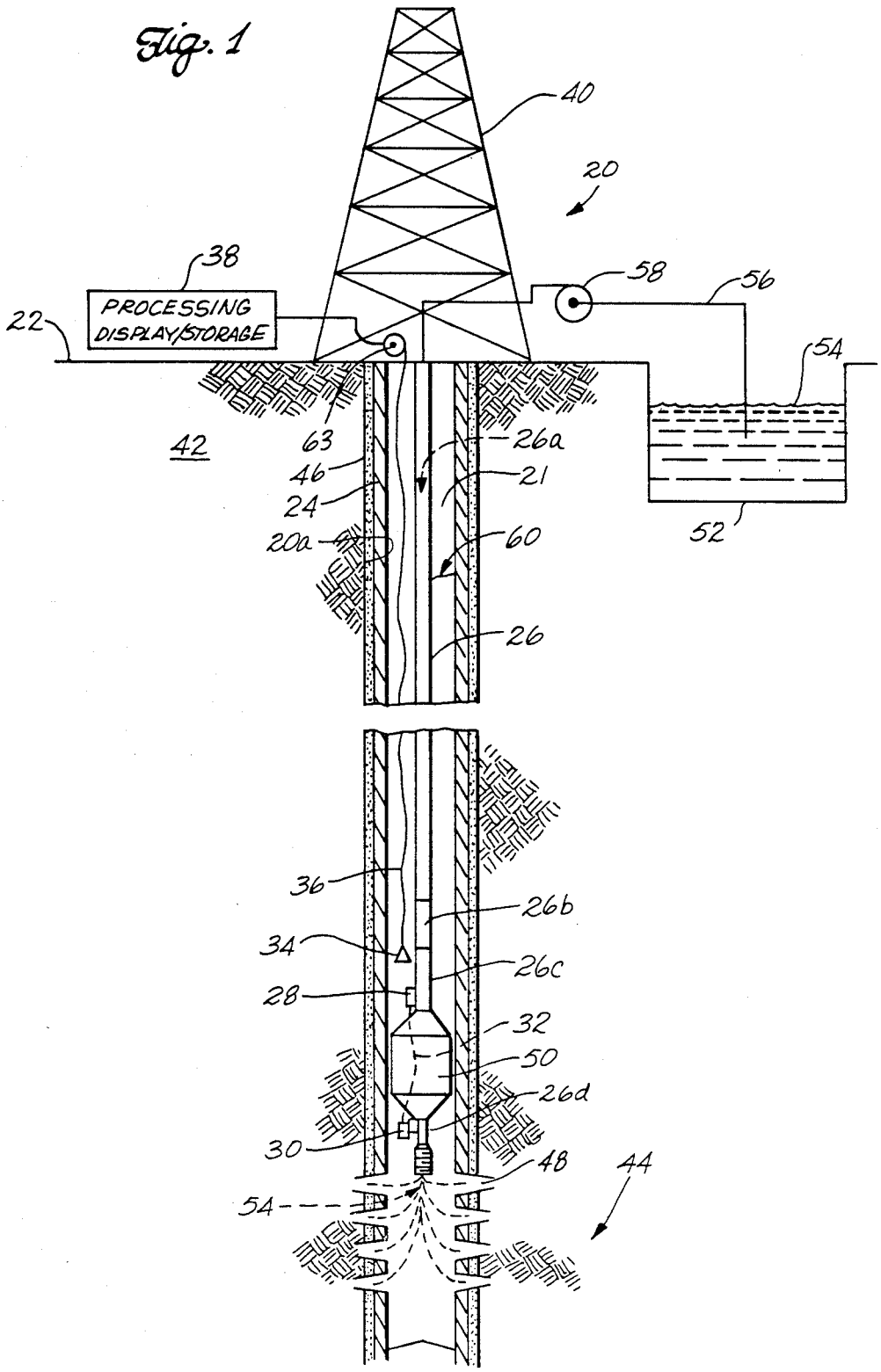
FIG. 1 is a schematic diagram of an oil or gas well showing tubular casing and cement in cross-sectional view to reveal the interior of the well. A wire line and transmitter are in the annulus between the tubing string and casing and a pressure sensor is mounted on a tubing string below the packer, and embodies the present invention.

FIG. 1 is a schematic and partial cross-sectional view of an oil or gas well 20 and depicts method and means for obtaining from down hole, data signals representing a parameter, preferably pressure, in the well. The well preferably has a tubular casing 24 on the inside well bore 20*a*. The casing need not extend to the bottom of the well bore. A tubing string 26 is disposed within a central passage of the well bore with a transmitter 28 mounted on tubing string for transmitting data. There is a space or annulus 21 between the tubing and well bore. A sensor 30 is mounted on the tubing string and is coupled to the transmitter through an electrical conductor 32. The sensor senses a parameter, such as pressure, in the well bore and communicates the parameter to the transmitter which sends data signals representing the parameter into the annulus 21. A receiver 34, schematically depicted in FIG. 1, is suspended on a flexible line, preferably wire line 36. The receiver and wire line are suspended in the annulus 21 at a location for receiving the data from the transmitter. Data signals representing the parameter are passed over the wire line to the top of the well bore. Preferably, the data signals are conducted up the wire line over an insulated conductor (to be described) to the top of the well bore. Processing, display and storage apparatus 38 is coupled to the wire line at the top of the well bore for receiving and processing the data signals from the wire line and for displaying and recording the parameter for the user.

The well bore extends into the earth 42 to a geologic stratum or formation 44 from which oil or other hydrocarbons are to be produced. The invention is especially well suited where the well bore may extend anywhere from to 5,000 to 20,000 feet or more below the surface. Though the apparatus and method, according to the present invention can be used in shallower well bores, it is especially well suited for deeper ones. The casing 24 extends from the top or surface of the well to and beyond the geologic formation 44, and is cemented to the earth with cement 46. To retrieve oil or gas from a region in the area of the well bore, one or more openings or perforations 48 are made in the casing and cement, using conventional techniques, for allowing flow of a fluid 54 between the interior of the string 26 and the formation 44. The fluid may be oil, water or fracturing fluid, but preferably a fracturing fluid is applied under pressure at a high flow rate through the tubing and perforation to the formation for creating, opening up or enlarging a fracture on the formation surrounding the well bore.

A generally cylindrical shaped packer 50, having a central passage, in communication with the central passage of the string, through which the fluid flows, is connected at the lower portion of tubing string 26 for substantially closing off the annulus 21 between the exterior of the tubing string and the casing above the perforations 48. The sensor 30 is mounted on a pipe or tubular member 26*d* of the tubing string immediately adjacent to and below the packer with the conductor 32 extending through the packer 50 to the transmitter 28. In an alternative embodiment, the conductor 32 may be affixed to and extend outside the packer to the transmitter. The transmitter is mounted on the tubing member 26*c* immediately adjacent to and above the packer.

A basin or tank 52 holds the fracturing fluid 54. Fluid 54, under the pressure developed in pump 58, is supplied through a supply line 56, through the central passage 26*a* of tubing string 26, through the packer 50 and through the perforations 48 to the formation.

In operation, the transmitter, sensor and packer are mounted to the tubing members of the tubing string and the tubing string are lowered with the transmitter and sensor to the desired position for the packer while the packer is radially collapsed. The tubing string lowering mechanism is located in the surface equipment 40, is conventionally in the art and therefore is not shown or described in detail. The position of the packer and sensor is immediately adjacent to and above the perforations 48. The packer is conventional, in that it is enlarged or radially actuated to contact the casing, and seal off the annulus 21 above the packer to the area below the packer. The receiver 34 is then lowered down the annulus 21 by means of, and supported at the end of wire line 36 to a position adjacent the transmitter so that data signals formed in the annulus by the transmitter can be received by the receiver. The pump is then started and the fracturing commences. Electronics in the sensor, transmitter and, to the extent present, in the receiver are active during the process of fracturing. For example, a start timer may be included in the transmitter which times out and activates the electronics. Alternatively, the electronics operations may be initiated before the tubing and packer are lowered in place.

As the fracturing fluid is forced through the perforations 48 and into the surrounding region the flow is impeded by the earth formation so that pressure is developed in the area of the perforations. The pressure is sensed by sensor 30 which produces signals for transmitter 28 which are a function of the pressure. The signals are manipulated or processed as desired and data signals representing the pressure are sent into the annulus 21 by transmitter 28 to and are received by the receiver 34. Data signals representing the pressure are then conducted along wire line 36 to the processing display and storage apparatus 38 for analysis, and display and/or storage.

The wire line is wound on a reel 63 at the top of the well. The receiver is made up on the end of the wire line and then the reel is rotated to unwind the wire line and lower the receiver down the annulus 21 as discussed above. Preferably the lowering of the receiver is done after the transmitter is lowered into place.

Figure 2:
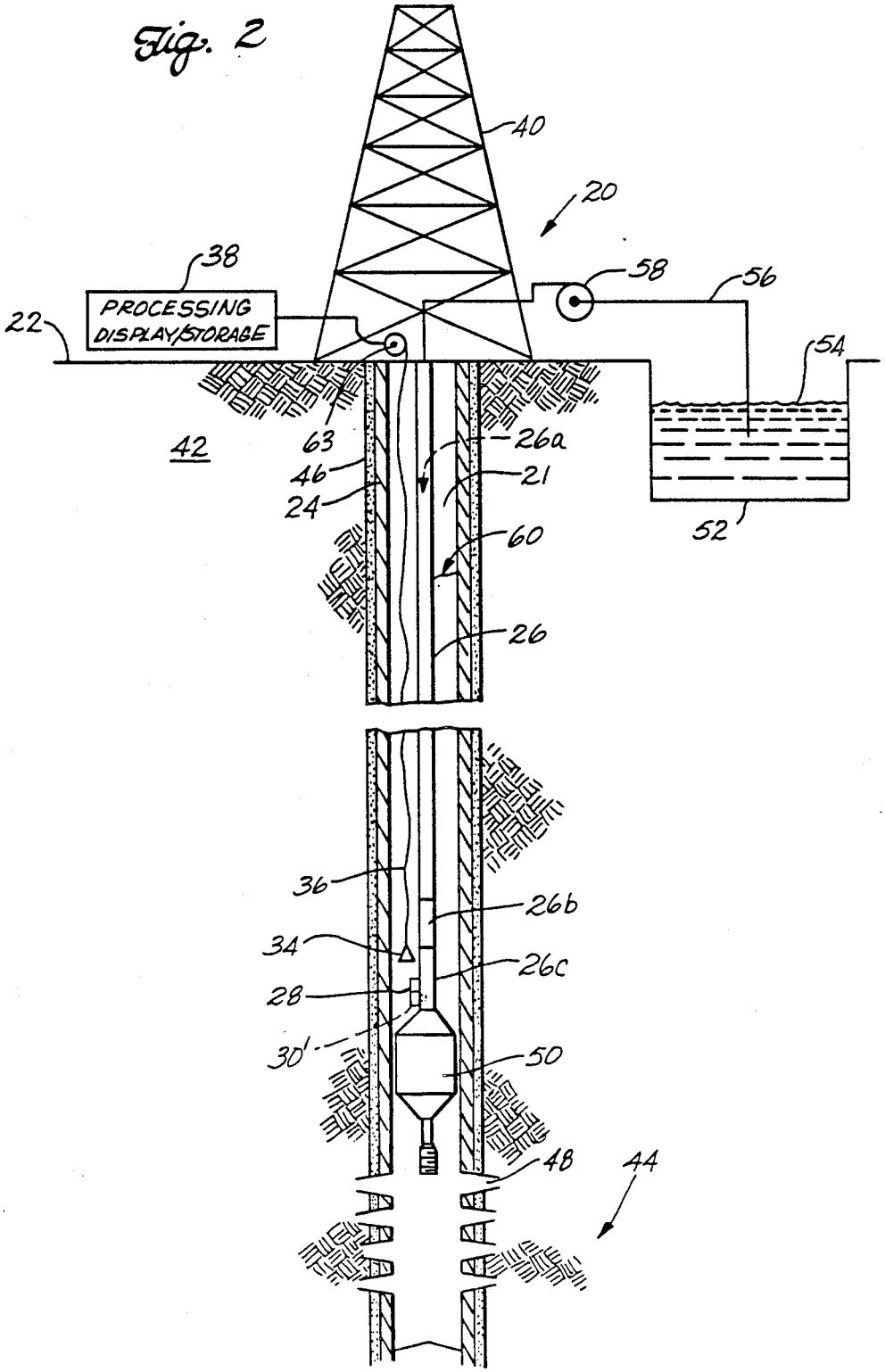
FIG. 2 is a schematic and partial cross-sectional view similar to FIG. 1 showing the pressure sensor on the tubing string above the packer, and embodies the present invention.

FIG. 2 is a schematic and cross-sectional view, similar to that depicting FIG. 1, except that the transmitter and sensor are both mounted on tubing member 26*c* of the tubing string 26 above the packer 50 and in the annulus. In this arrangement the sensor 30' has its pressure sensing mechanism tapped or connected through the wall of the tubing string to the central passage so that fluid pressure inside of the tubing string is sensed. The transmitter 28 sends data signals representing the sensed pressure into the annulus 21 to the receiver 34 as discussed in connection with FIG. 1.

Figure 2A:
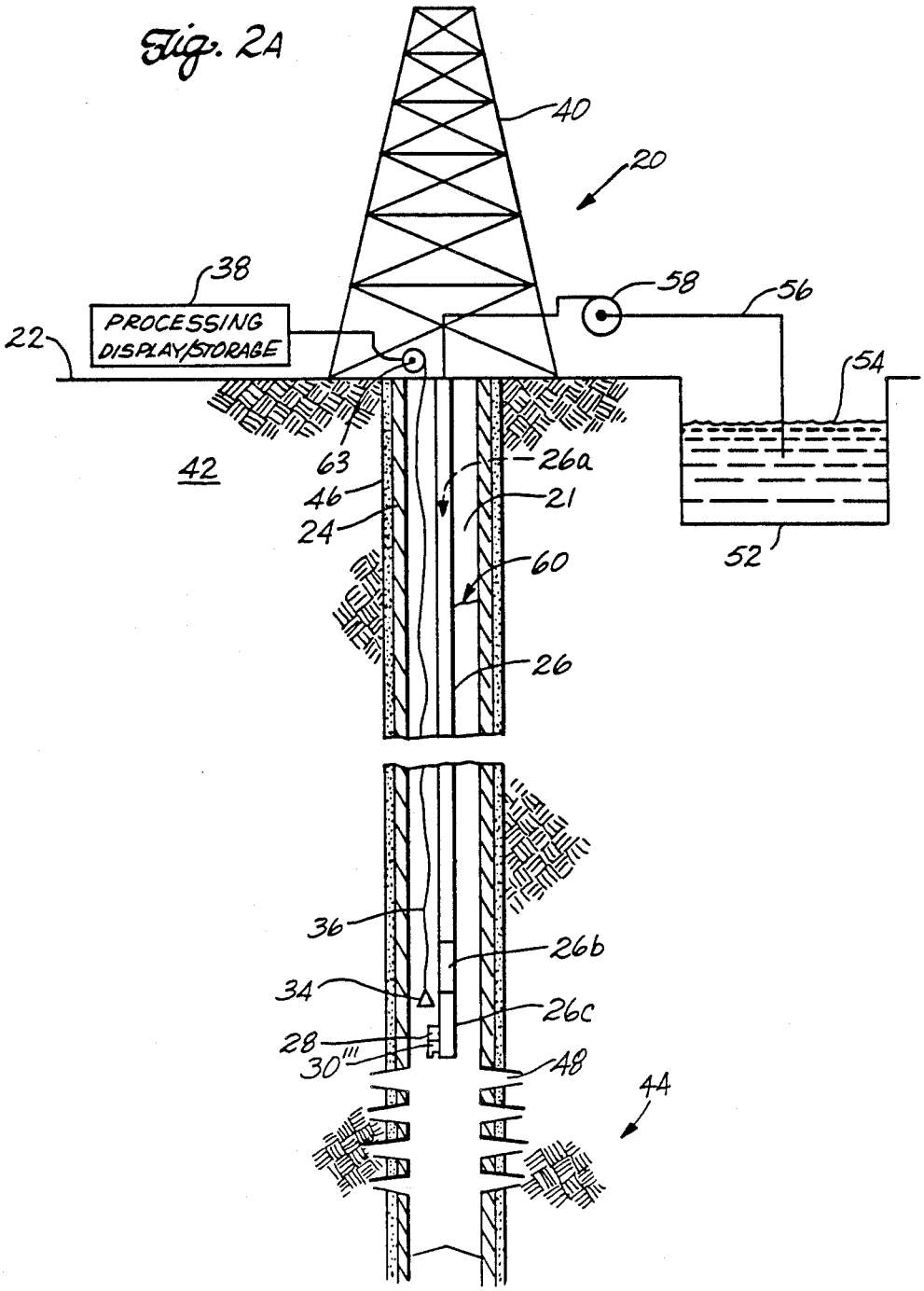
FIG. 2A is a schematic and partial cross-sectional view similar to FIG. 2 without a packer on the lower end of the tubing string.

FIG. 2A is an alternate arrangement similar to FIG. 2 where a packer is not used, and an alternate pressure sensor 30''' is employed which senses pressure in the annulus and hence in the central passage of the casing at the end of the tubing string. Means (not shown) is provided at the top of the well to seal the annulus and prevent fluid from passing upward out of the annulus. This arrangement allows bottom hole pressure to be sensed and communicated to the top of the well in a completed well during fracturing as desired. This arrangement allows the fracturing fluid to be passed down the tubing string so that the flow of fluid is out of direct contact with the wire line and minimizes downward drag force on the wire line.

Figure 3:
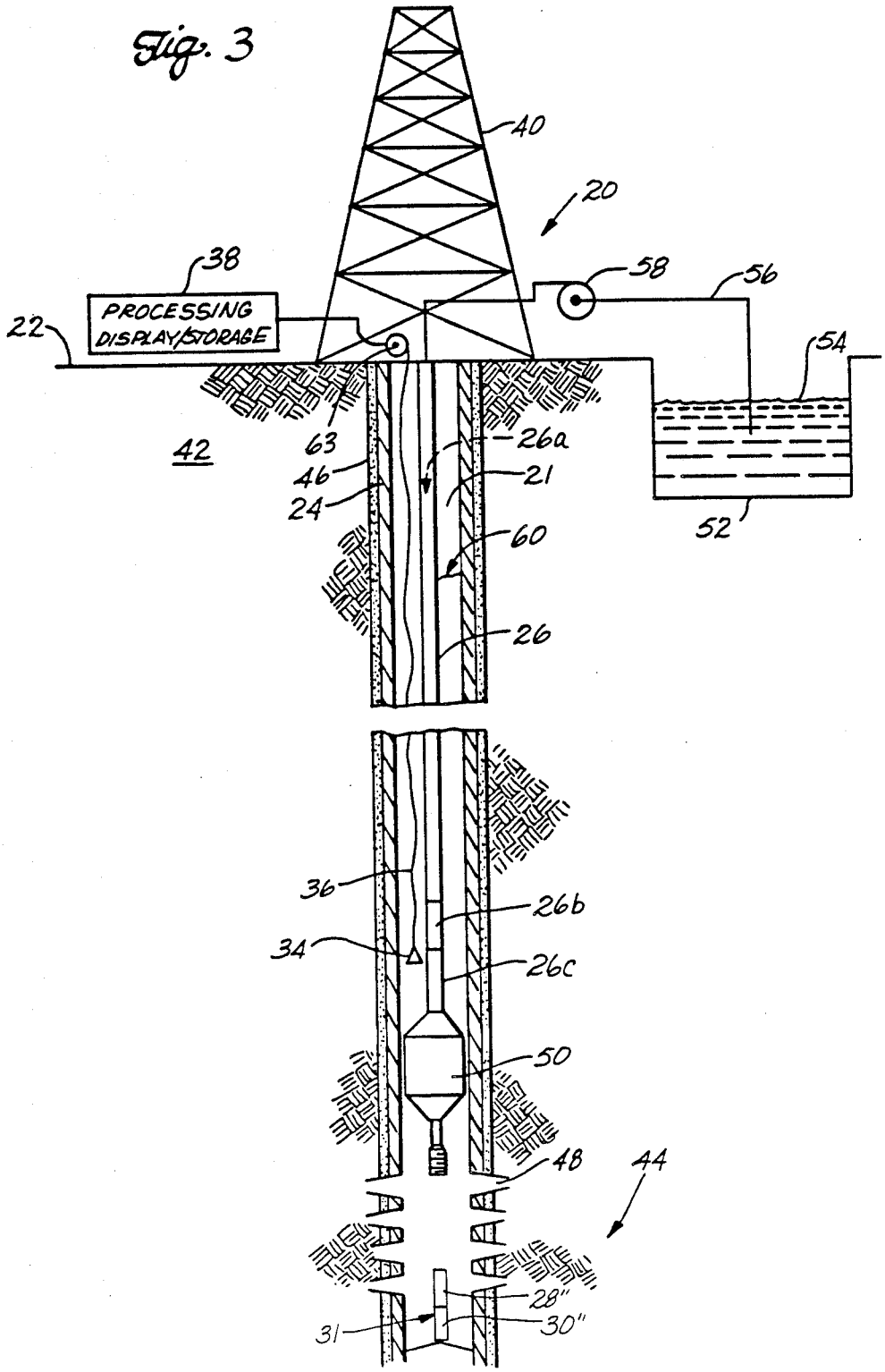
FIG. 3 is a schematic and partial cross-sectional view similar to FIG. 1 showing the pressure sensor and a transmitter at the bottom of the well bore, and embodies the present invention.

FIG. 3 depicts a further alternate arrangement similar to that depicted in FIG. 1 wherein the sensor and transmitter, instead of being mounted on the tubing string 26, are dropped down the central passage 26a of the tubing string 26, or are dropped down the central passage of the casing 24 or well bore prior to insertion of the tubing string 26, and allowed to come to rest at the bottom of the well bore or on a plug in the well. Transmitter 28'' and the sensor 30'' are housed in a common module or housing indicated at 31 in FIG. 3. When enclosed in a common module the sensor and transmitter can be dropped down the tubing string or the casing and allowed to come to rest at the bottom ot the well under the pull of gravity or can be assisted in its downward movement by the force of pressurized fluid being pumped down the tubing string or casing. The casing may be cut short of the bottom of the well bore leaving an uncased portion at the bottom of the well bore. It is possible that the sensor and transmitter will be located below the casing, but of course, still in the well bore.

Preferably the wire line includes a central insulated conductor which extends to the top of the well bore. The data signals representing the pressure parameters transmitted by transmitter 28 are received by receiver 34 and data signals representing the parameter are conducted up to the top of the well bore over the insulated conductor contained in the wire line. The wire line may be constructed in a number of different ways, but must be of suitable strength to support the receiver and withstand the harsh environment in the annulus 21, and must extend from the desired position of the receiver (as close as possible to the transmitter) to the top of the well.

The flexible line may be an insulated coaxial cable. However, preferably the flexible line is a wire line similar to that conventionally used in the oil tool art, and as depicted at 36 in FIG. 4 has a central insulated conductor 36a, insulation 36b surrounding the central conductor 36a and an outer metal sheath 36c which protects the wire line from the abrasive effects of the fluid and other materials in the well with which it comes in contact when in or moving down the annulus of the well. The wire line 36, including the central conductor 36a, the insulation 36b and outer sheath 36c extend to the top of the well, and are wound the reel 63. The wire line and its components are sufficiently flexible so that they can be wound on a reel. Preferably the conductor 36a is stranded.

It is typical in the well drilling art to make up the tubing string out of a number of separate pipes or annular members threaded end to end. The packer 50 and sensor and transmitter connected to the tubular string are lowered into the well by adding pipes one at a time to the uppermost end of the tubing string, lowering the tubing string with the connected packer into the well.

It will be understood by those skilled in this art that procedures need to be followed to prevent the inlet to the sensor from plugging up with particles from the fluid. This may be accomplished by making the sensor opening large enough that the particles do not wedge in the opening or by positioning the pressure sensing surface flush with the opening to the sensor.

Figure 4:
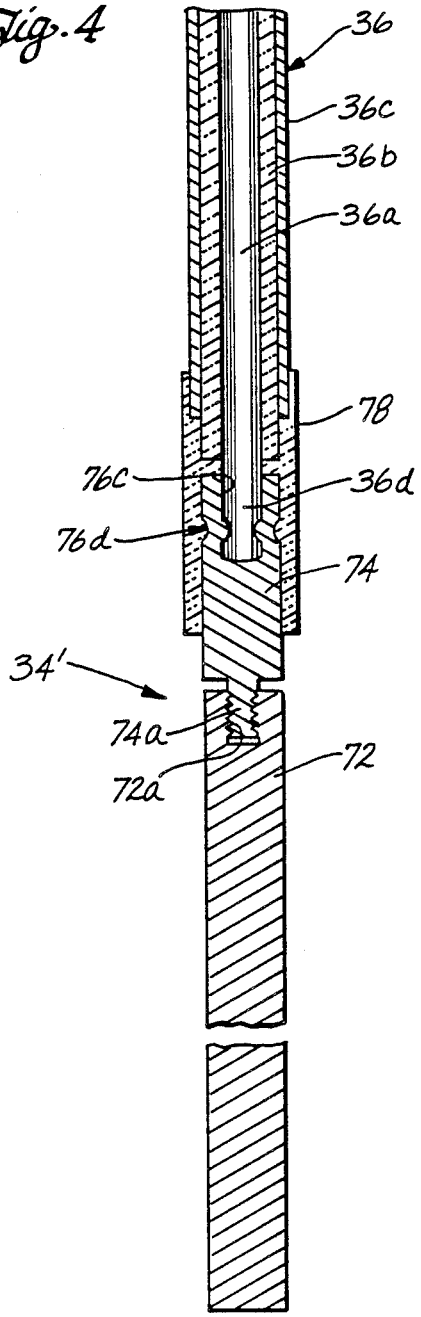
FIG. 4 is a cross-sectional view of a wire line and a receiver for receiving potentials from a conductive fluid for use in the systems of FIGS. 1–3.

Refer now to FIG. 4 and consider the the receiver according to the present invention. A receiver 34' is shown which is for use with a conductive fluid 60, in the annulus 21 and is adapted for receiving electrical potentials (or data signals), representing the sensed parameters, which are created in the conductive fluid.

The receiver is comprised of an electrically conductive, elongated and cylindrical shaped metallic conductor or electrode 72. The electrode 72 is preferably copper plated steel and is exposed so that it will be in electrical contact with the surrounding conductive fluid. The electrode 72 is suspended at the end of wire line 36 by means of a cylindrical shaped coupler 74, which is affixed, preferably by crimping 76d to the lower end of the insulated conductor 36a from which the insulation 36b has been stripped. The coupler 74 is an electrically conductive material having an axial bore into which the end of the insulated conductor 36a is inserted and crimped. The crimping provides a rigid mounting or attachment, as well as a good electrical connection to the end of the insulated conductor 36a The coupler 74 also has a threaded coaxial extension 74a which is smaller in diameter than the adjacent portion of the coupler. The electrode 72 has a threaded coaxial bore 72a into which the extension 74a is threaded. A cylindrical shaped electrically conductive metal sheath or jacket 36c is cut slightly shorter than the insulator 36b, leaving a protruding sleeve of the insulator 36b. Insulator 36b is cut short to leave a protruding portion 36d of the conductor 36a. Tubular shaped insulator 78, preferably fiberglass or epoxy, extends completely around the perimeter of the lower end of the jacket 36c, the protruding end of the insulator 36b, any protruding portion of the conductor 36a which is exposed and the upper portion of the coupler 74. This construction prevents any direct short circuit between the lower end of the jacket 36c and the insulated conductor 36a, the coupler 74 or the electrode 72. The diameter of the jacket 36c, the insulator 78, the coupler 74 and the electrode 72 are all substantially the same, with the insulator 78 slightly, but not appreciably, larger since it extends around the exterior of the jacket 36c and the coupler 74. As a result the assembly depicted in FIG. 3, including the wire line, electrode and the insulator 78, provide a smooth surface to the flow of fluid, thereby reducing turbulance in flowing fluid and reducing wear on the receiver and facilitating insertion into the annulus. Preferably the outer diameter of the jacket on the wire line, the insulator 78 and the electrode 72 are all substantially 0.5 inches.

An optimum and preferred length for the electrode 72 is between 3 and 10 feet. The longer the electrode the better the contact between the conductive fluid and the electrode and hence the higher the signal to noise ratio of the received signal at the top of the well. However, the shorter the electrode the easier it will be to lower the electrode on the end of the wire down to the desired position in a narrow annulus.

The receiver shown in FIG. 4 is be employed in the system depicted in FIGS. 1, 2 or 3. However, in FIG. 3 the resistance to the flow of current from the transmitter to the receiver must be low enough to provide a detectable potential on the electrode in the receiver. To this end it is desirable that the casing be electrically conductive, and that the lower portion of the tubing, such as tubular member 26c, be electrically conductive.

What has been disclosed with reference to FIGS. 1–4, is a method for obtaining data signals representing a parameter from down hole up to the top of a well bore, where the well bore contains a conductive fluid. The data signals represent a parameter down hole in the well bore. The method is briefly as follows: A sensor and a transmitter are lowered down hole inside of the well bore. An exposed electrode receiver is lowered down hole inside of the well bore, separately from the sensor and transmitter, while suspended at the end of a wire line, while the wire line extends to the top of the well bore. Electrical potentials representing a parameter sensed by the sensor are created with the transmitter and received with the electrode receiver in conductive fluid in contact with with electrode receiver. Data signals representing the parameter represented by the received electrical potentials are passed up to the top of the well bore over the wire line.

Figure 4A:
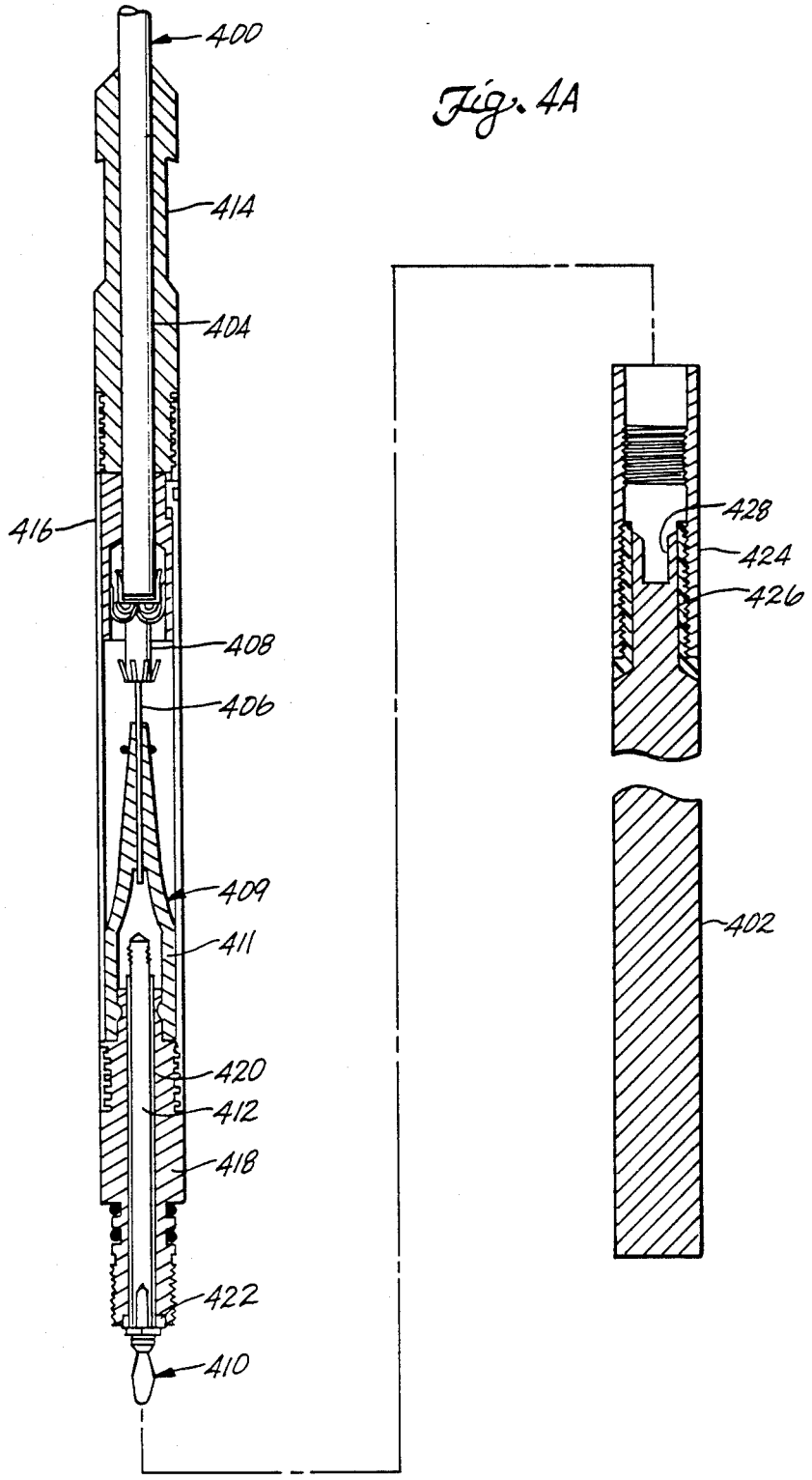
FIG. 4A is a cross-sectional and exploded view of an alternate receiver and make up to a wire line where the receiver is for receiving potentials from conductive fluid in the annulus.

FIG. 4A is a cross-sectional view of an alternate receiver made up on a wire line for receiving potentials from the conductive fluid in the annulus. A wire line 400 has an electrode type receiver 402, very similar to that disclosed with reference to FIG. 4, suspended at the end of the wire line. The wire line has an outer sheath 404, a central insulated conductor 406 and an annular insulator 408 separating the conductor 406 from the conductive sheath 404. The conductor 406 is connected to a spring contact or banana plug 410 by means of a terminal nut 409 having a circular bore into which the exposed end of the conductor 406 is inserted and crimped. The opposite end of the terminal nut 409 has a bore into which an end of contact rod 412 is threaded. The opposite end of the rod 412 has a threaded bore into which the rear end of banana plug 410 is threaded. The nut and electrically connected rod and plug, all being electrically conductive materials, provide continuous electrical path between the insulated conductor 406 and the plug 410. The conductive outer sheath 404 of the wire line is electrically connected in a babbit-type stinger 414 which in turn is threaded into one end of an electrically conductive sleeve 416. The opposite end of the sleeve 416 is threaded over the end of an electrically conductive contact sub 418, which in turn is electrically isolated from the rod 412 by an insulating sleeve 420 from plug 410 by an insulating washer 422.

Electrode 402 has its upper externally threaded end threaded into a sleeve-shaped coupler 424. An insulating sleeve 426 on the electrode 402 electrically insulates the electrode 402 from the coupler 424. The upper end of the electrode 402 contains a bore 428 into which the plug 410 is inserted. The upper end of the coupler 424 is constructed so that the coupler can be inserted over and threaded onto the lower end of the sub 418 until the plug 410 is in the bore 428 and in an electrical contact with the electrode 402. As a result, an electrical path is provided from the conductor 406 to the electrode 403 and the wire line sheath 404 is electrically insulated from the electrode.

Figure 5:
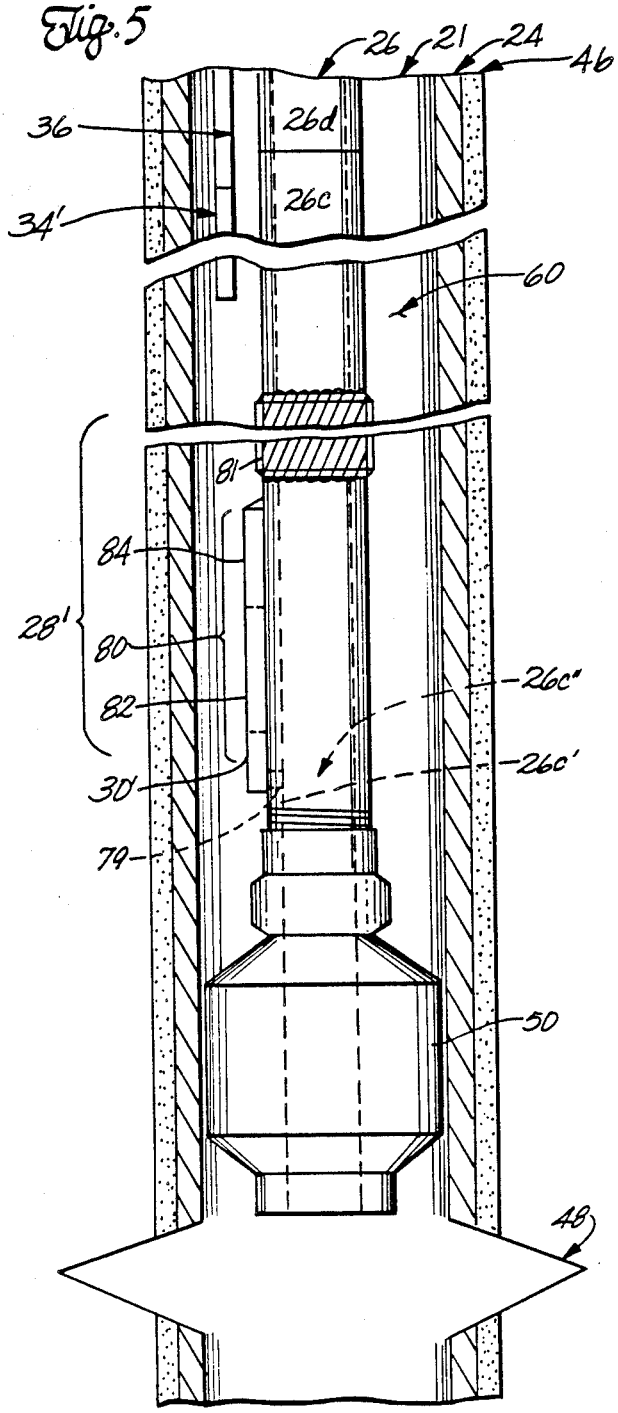
FIG. 5 is a schematic diagram of the lower portion of FIG. 2 depicting in more detail a transmitter mounted on the tubing string and a receiver for receiving potentials from conductive fluid in the annulus.

FIG. 5 depicts in more detail and more closely to scale a preferred embodiment of the present invention with a single electrode type receiver 34', and wire line of the type depicted in FIG. 4, together with a transmitter 28' and sensor 30' on the string above the pack similar to that depicted in FIG. 2. FIG. 5 depicts the lower two tubular members **26*d* and 26*c* of the tubing string 26, the electrically conductive casing 24, cement 46, annulus 21, the packer 50 and perforations 48, packer 50 is threaded on the lower end of the annular member 26*c*. Sensor 30' is of the pressure sensor type, and a passage 79 is tapped through the wall 26*c'* of the lower tubular member 26*c* to the central passage 26*c''* of the member 26*c*** to allow sensing of pressure in the central passage due, for example, to the fracturing fluid.

Transmitter 28' includes electronic section 80 and elongated coil 81 encircling and coaxial with the tubular member **26*c*. Electronic section 80 includes a battery section 82 for providing power to the electronics and sensor and an voltage to frequency convertor 84. The sensor 30' may be any one of a number of conventional sensors for sensing pressure and for providing an analog output signal proportional to the pressure sensed within the central passage of the tubing string (see discussion above). The voltage to frequency convertor 84 receives the analog signal and converts it to a frequency modulated signal which is proportional to the analog signal and applies the frequency modulated signal to the coil 81. The coil 81 in turn induces current to flow longitudinally in the wall 26*c'* of the tubular member 26*c*. Electrically conductive fluid 60 in the annulus 21 conducts the current to the electrode receiver 34' and as a result, a potential is formed on the electrode receiver 34'** relative to a reference. The reference in this embodiment of the invention may be the earth, the well casing, the tubing string, or the sheath on the outside of the wire line at the top of the well.

Figure 6:
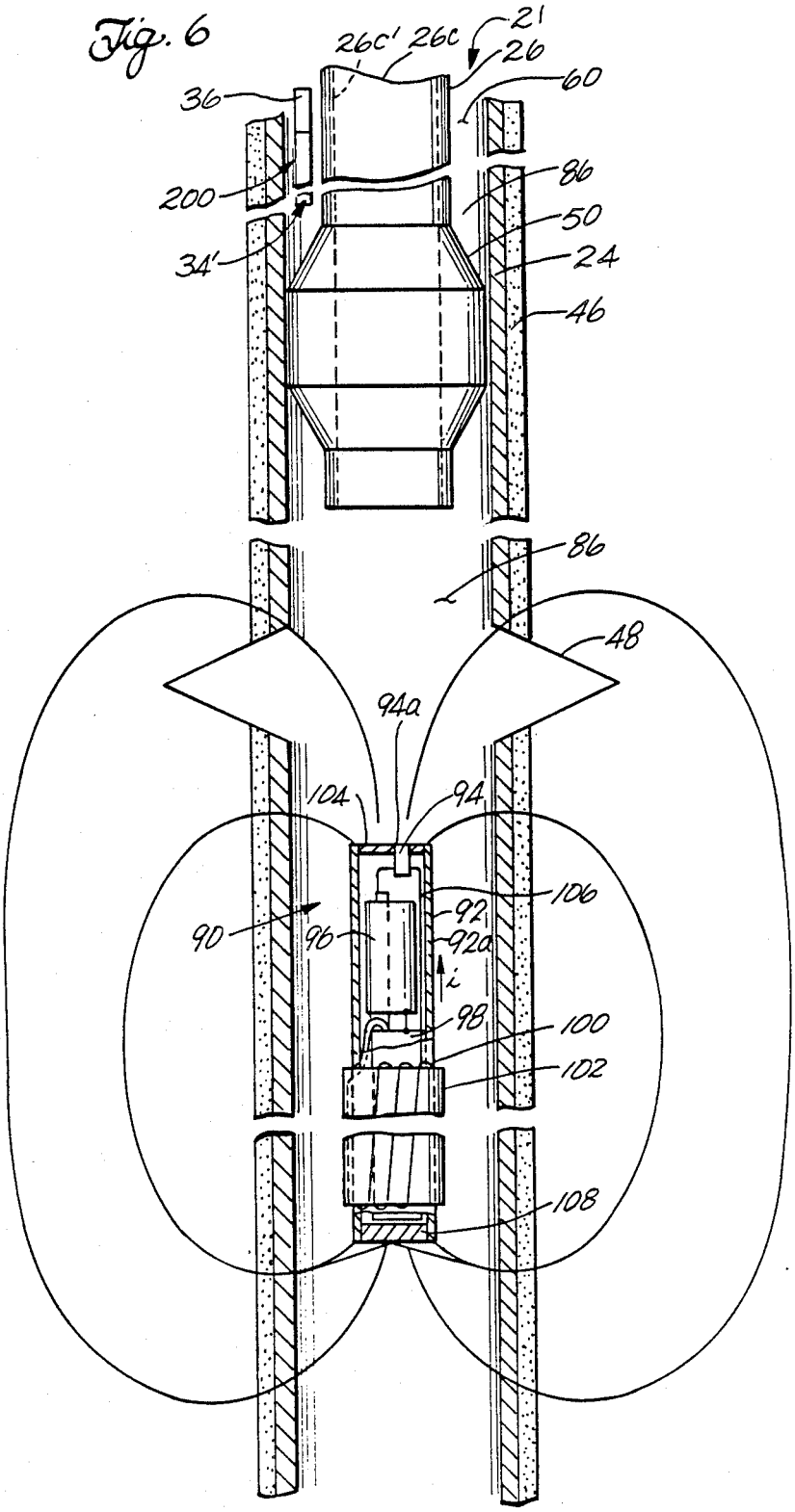
FIG. 6 depicts in more detail the lower portion of FIG. 3 in which the sensor and transmitter are mounted in a common module and passed down the central passage of the tubing string and a receiver for receiving potential differences from conductive fluid is positioned in the annulus.

FIG. 6 depicts in more detail the arrangement of FIG. 3 where the sensor and transmitter are dropped or "air mailed" down the central passage of the tubing string and packer to the bottom of the well bore. FIG. 6 again depicts in cross section the casing 24, cement 46, tubing string 26, and annulus 21 as well as conductive fluid 60, and the packer 50. Wire line 36 and single electrode receiver 34', similar to that described with reference to FIG. 4, are located in the annulus 21.

The transmitter is generally depicted at 90 and is in a single modular construction together with the sensor allowing the transmitter and sensor to be dropped down the central passage of the tubing string. More specifically, the module includes an elongated, preferably about 2 foot long, segment of tubing 92 containing therein pressure sensor 94, battery 96, voltage to frequency convertor 98 and an elongated coil 100. Preferably coil 100 is mounted on a tubular shaped ferrite core 102 and together are mounted on the outside of and coaxial with tubing 92. The windings of the coil 100 are wound longitudinally along the tubular core 102 and set up a longitudinally extending flow of current in tubing 92 as depicted at "i". The current induced in the tubing 92 flows longitudinally along the wall **92*a* of the tubing 92 into surrounding conductive fracturing fluid 86 through the wall 26*c'* of member 26*c* and through the casing 24 and hence through the conductive fluid 60 in annulus 21 to the receiver 34' ocausing a potential to be induced on the receiver 34' relative to a reference as discussed in connection with FIG. 5**.

Plugs 104 and 108, preferably made of electrically conductive material, are inserted in the opposite ends of the tubing 92 for sealing the inside of the tubing (and hence the sensor, the battery and the electronics) from the surrounding fluid. The sensor 94 has a passage **94*a* tapped through the plug 104 for sensing pressure external to the module. The coil 100 is insulated from the core and from the tubing 92 by insulation (not shown). Because of the alternating current frequency generated by the coil 100 circulating eddy currents may be set up in the tubing 92** as well as the longitudinal currents. However, the frequency of the signal is preferably sufficiently low that the eddy currents can be made small.

In some applications it will be desirable to insulate the length of the tubing 92 while using electrically conductive plugs exposed in the ends of the tube, thereby causing the longitudinally extending induced currents to flow out of the plugs into the conductive fluid. This would minimize linkage current from the sides of the tubing 92.

Figure 7:
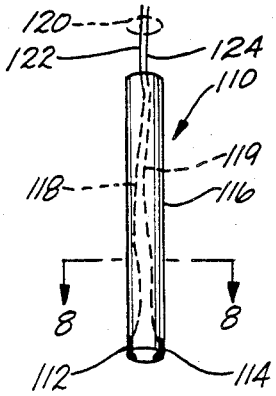
FIG. 7 is a schematic diagram depicting a dipole type receiver in which two horizontally displaced electrodes receive potential differences from conductive fluid in the annulus of FIGS. 1, 2 and 3.
Figure 8:
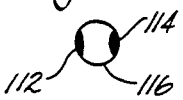
FIG. 8 is a cross-sectional view of the receiver of FIG. 7 taken along the lines 8—8.

FIGS. 7 and 8 depict an alternate horizontal receiver 110 of the dipole type for receiving potentials which has a pair of horizontally displaced exposed electrodes 112 and 114 connected by leads 118 and 119 to insulated conductors 122 and 124, respectfully on or in a wire line 120. The insulated conductors 122 and 124 and the wire line 120 extend to the top of the well. If a shielded wire line is used as in FIG. 4 one of conductors 122 and 124 may be connected to the shield and the other to the central conductor. The exposed electrodes 112 and 114 are recessed into or otherwise mounted on the bottom and partially up the side of a cylindrical rod 116 made of an insulating material. When the receiver of FIG. 7 is used in place of the receiver of FIG. 4 the signal created in the conductive fluid causes a potential difference between the horizontally spaced electrodes 112 and 114, which can be sensed at the top of the well between the conductors 122 and 124.

Figure 9:
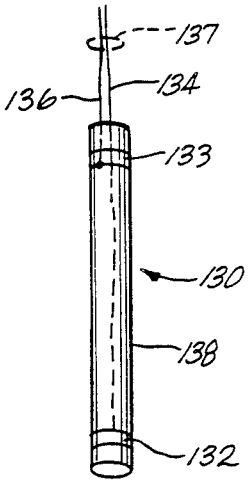
FIG. 9 is a schematic diagram of a vertical dipole receiver.

FIG. 9 depicts an alternate verticle dipole type receiver 130 which has vertically displaced electrodes 132 and 133 electrically connected, respectfully, to insulated conductors 134 and 136 in a wire line indicated at 137 which in turn extends to the top of the well similar to wire line 120 of FIG. 7. Electrodes 132 and 133 are ring shaped, recessed and mounted coaxially with and around the periphery of cylindrical rod 138, which is made of an insulating material.

The vertically displaced electrodes 132 and 133 the horizontally displaced electrodes 112 and 114 of FIG. 7 are spaced sufficiently far apart to receive a potential difference on the spaced electrodes of a sufficient magnitude to be detected. The electrodes in both FIGS. 7 and 9 are recessed to protect the electrodes from physical contact with the tubing casing, fluids or other material as the receiver is passed down through the annulus and also to prevent a direct short between the electrodes due to the interv conductive fluid. The larger the spacing between the electrodes the larger the signal will become between the electrodes.

Figure 9A:
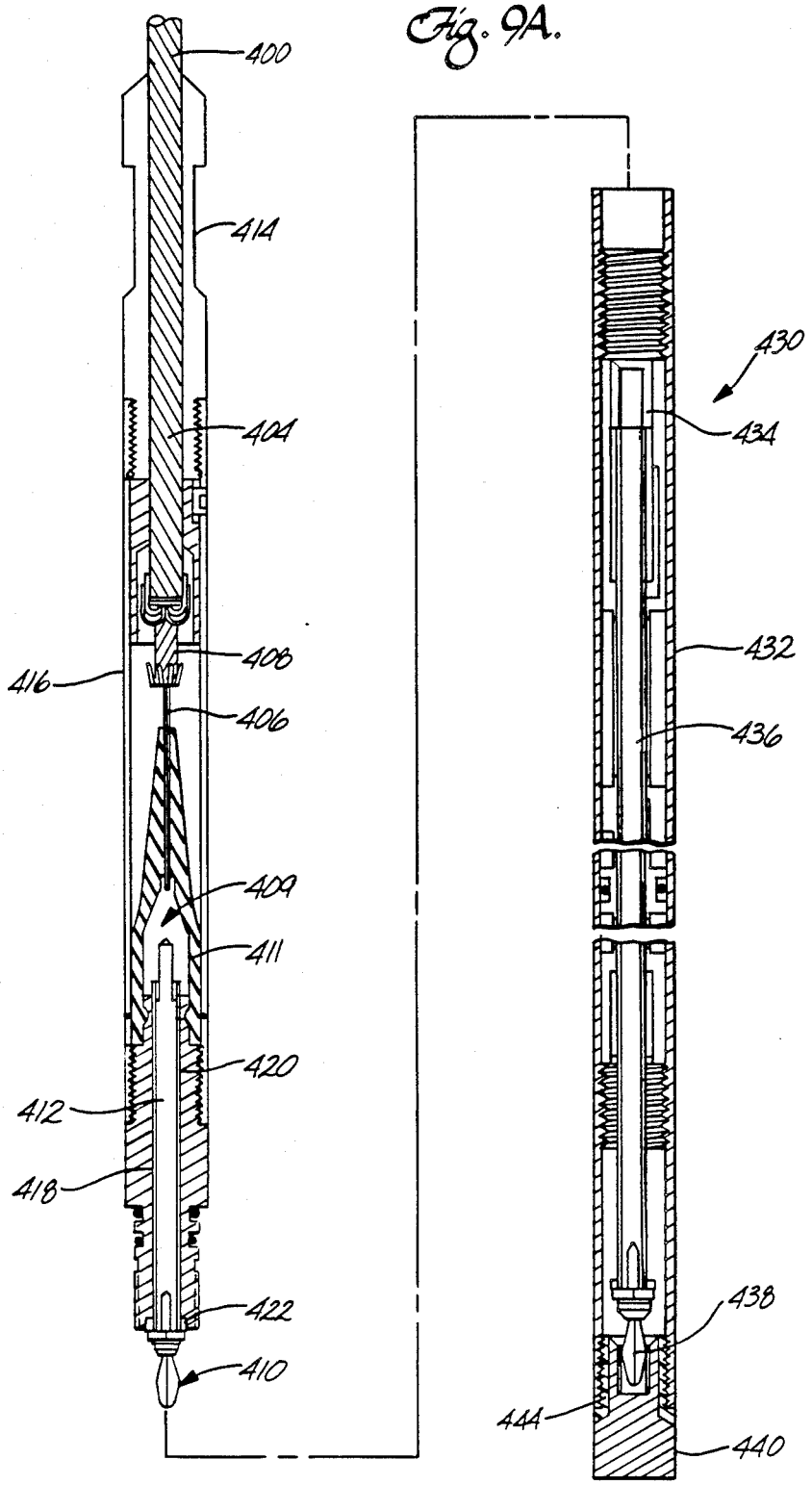
FIG. 9A is a schematic, cross-sectional and exploded view of a preferred vertical dipole receiver.

Refer now to the vertical dipole receiver of FIG. 9A. The wire line 400 and a cable-head assembly are present and are identical to that described herei with respect to FIG. 4A. The dipole assembly, which is connected to the end of the cable-head assembly is depicted at 430 and includes a tubular member 432 whose upper end is threaded onto the lower end of the cable head. A top receptacle 434 receives and forms an electrical contact with the spring contact 410 as discussed above. A contact rod 436 electrically connects the receptacle 434 to the threaded rear end of a spring contact or plug 438, in a similar manner to the connection of plug 410 to rod 412. The upper electrode of the dipole is formed by the electrically conductive outer surface of the sleeve 416. The lower electrode is formed by an electrically conduct plug 440 which has a cylindrical outer surface exposed for electrical contact with the surrounding fluid. The outer surfaces of both the sleeve 416 and the plug 440 are copper plated to enhance conductivity. If needed, the sleeve or tubular member 432 may either be made of a non-conductive material or of a conductive material, but with a non-conductive epoxy coating covering the outside, so as to electrically insulate it from the conductive fluid. The plug 440 is threaded into the lower end of sleeve 432. A non-conductive sleeve 444 on plug 440 electrically isolates the plug 440 from the sleeve or tubular member 432. The sleeve or tubular sleeve 432 is electrically insulated by insulators from the receptacle 434, rod 436 and plug 438 as generally indicated in FIG. 9A.

Figure 10:
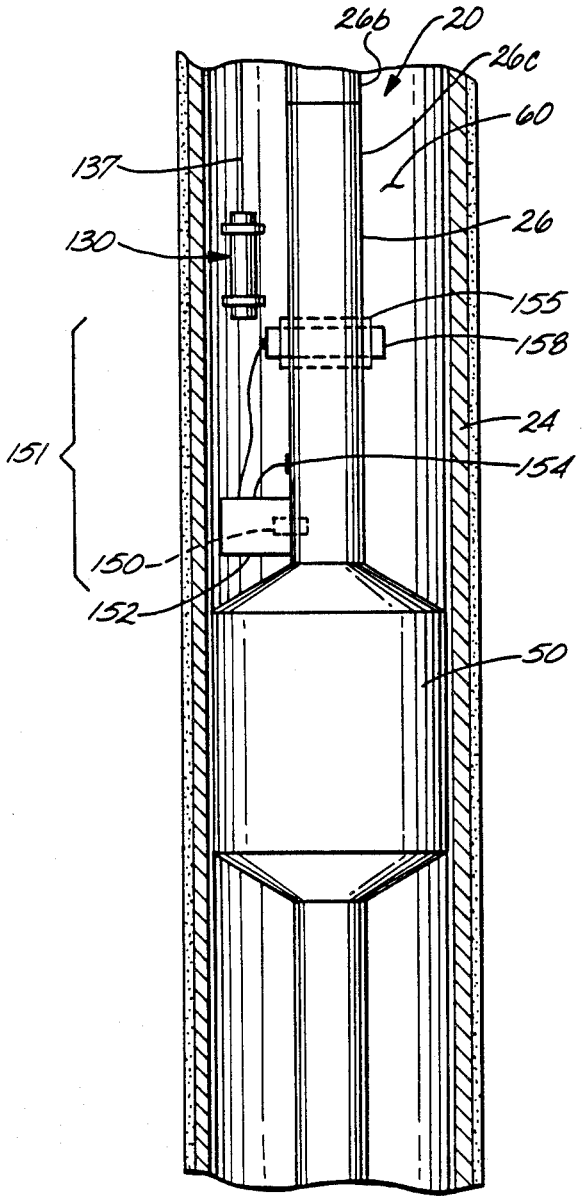
FIG. 10 depicts the details of one arrangement for the lower portion of FIG. 2 in which the sensor and transmitter are mounted on the tubing string above the packer and the receiver receives potentials from conductive fluid in the annulus.

FIG. 10 depicts an alternate transmitter 151 for use with the receiver 130 and wire line 137 of FIG. 9 or that of FIG. 9A. As in FIG. 5, FIG. 10 shows tubing string 26, casing 24, cement 46, and packer 50 and a sensor 150 whose sensing input is tapped through the wall of the tubular member 26c to the inside passage of the tubing string. The transmitter includes a battery unit and an electronics (such as a frequency convertor) unit 152 similar to 82 and 84 of FIG. 5, which are mounted on member 26c and converts the analog signal representing pressure from the sensor to a frequency signal the outputs of which are applied between an electrode 154 on electrically conductive tubular member 26c and electrode 158. Electrode 158 is a conductive copper ring which is mechanically mounted on and coaxially around the member 26c. Ring 158 is electrically insulated from member 26c by a non-conductive ring shaped sleeve 155. With this arrangement the signals provided by the transmitter 151 are applied between electrodes 154 and 158 which in turn causes electrical current to flow in the member 26c along the member 26c which in turn causes current to flow in the electrically conductive fluid 60 which in turn causes a potential difference between the electrodes 142 and 144 of the receiver 130. It should be noted, however, that the spacing between electrodes 154 and 158 should be sufficient to produce the required potential difference between the electrodes 142 and 144. Preferably the receiver is positioned close by and preferably in between electrodes 154 and 158 so as to maximize the potential difference between electrodes 142 and 144.

Figure 11:
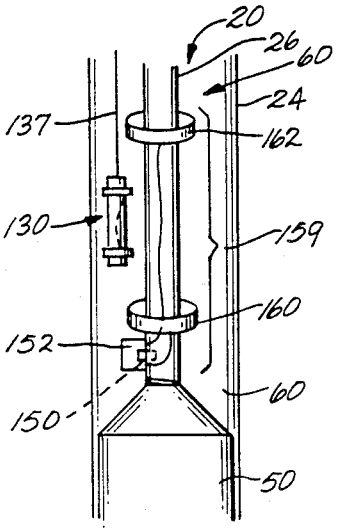
FIG. 11 is a schematic diagram of the lower portion of a system similar to that depicted in FIG. in which the sensor and transmitter are mounted on the lower portion of the tubing string above the packer and a receiver for receiving potentials from conductive fluid is located in the annulus.

FIG. 11 depicts a tubing string 26 within a conductive metal casing 24 having a packer 50 connected at the lower end, all similar to that discussed above with respect to FIG. 10, mounted on the tubing string is a transmitter 159 which includes battery and electronics unit 152, plus a sensor 150 both similar to that of FIG. 10. The output from the electronics unit 152 between which signals are formed with a frequency representing the sensed pressure are applied between vertically displaced electrically conductive electrode rings 160 and 162 in the transmitter. The rings 160 and 162 similar to the ring 158 of FIG. 10 are electrically insulated by insulator means (not shown) from and are mounted on and coaxially about the tubing string 26. A receiver 130 similar to that disclosed in FIG. 9 is positioned in between the spaced apart electrode rings 160 and 162. With this arrangement where the receiver 130 is positioned between the electrode rings 160 and 162 the potential difference on the receiver electrodes will be greater and therefore easier to detect than in the embodiment depicted in FIG. 10.

Figure 12:
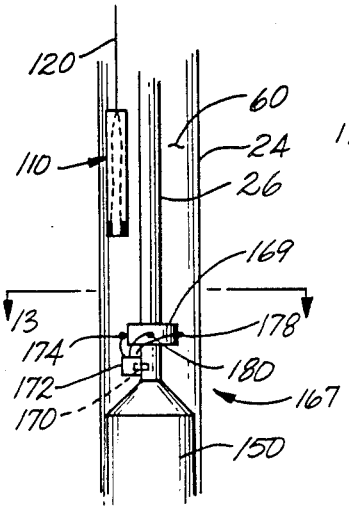
FIG. 12 is a schematic and cross-sectional view similar to FIG. 11 depicting an alternate arrangement in which the receiver receives potentials from conductive fluid in the annulus.
Figure 13:
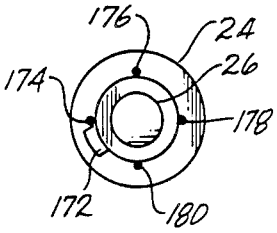
FIG. 13 is a cross-sectional view taken along the lines 13—13 of FIG. 12.

FIGS. 12 and 13 depict a receiver 110 suspended from the end of a wire line 120, similar to that disclosed in FIG. 7, in annulus 21 between a tubing string 26 and conductive metal casing 24. A packer 50 is at the lower end of the tubing string. Transmitter 167 includes a non-conductive ring 169 coaxial with and mounted on the tubing string 26. Electrodes 174, 176, 178 and 180 are equally spaced at 90° with respect to each other and are mounted on the periphery of the ring 169. The transmitter 167 also includes electronics and battery unit 172. The unit 172 and a sensor 170, which is tapped through the wall of the tubing 26 to sense pressure in the central passage are mounted on the tubing string 26. The unit 172 converts the analog signal from pressure sensor 170 to a frequency signal and then applies the signal for the electrodes. The signal on each electrode is 90° out of phase with respect to the signal applied to the adjacent electrode and 180° out of phase with the electrode on the diametrically opposite side of the ring 169. With this arrangement the receiver 110 will be less sensitive to the relative orientation between the receiver and the electrodes in the transmitter.

Figure 14:
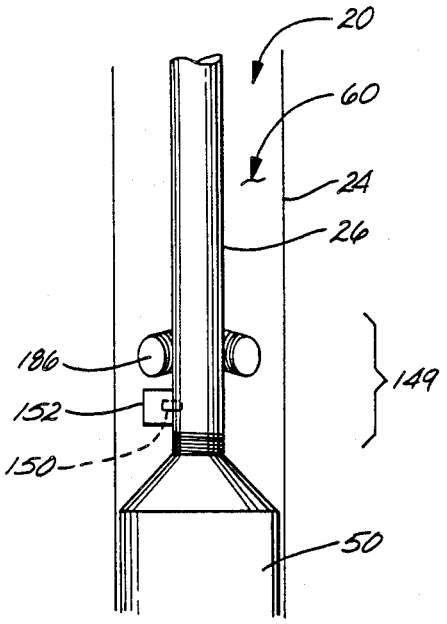
FIG. 14 is a schematic and cross-sectional view depicting the lower end of a tubing string, a packer with a sensor and transmitter mounted on the tubing string above the packer, disclosing a specific form of the transmitter.

FIG. 14 depicts an alternate transmitter 149 including an electronics and battery unit 152, and a sensor 150 similar to that disclosed with reference to FIG. 11 but adapted for providing a frequency signal corresponding to the sensed pressure to a donut shaped coil on a core as depicted at 186. The coil 186 on the core is mounted coaxially around one of the tubular members of the tubing string 26. Energization of the coil causes current to flow longitudinally in the conductive tubing string 26 which in turn sets up potentials in surrounding conductive fluid which in turn will be picked up by a receiver in the annulus as discussed above. Preferably the receiver (not shown) is one with vertically displaced exposed electrodes similar to that discussed with reference to FIG. 9.

Figure 15:
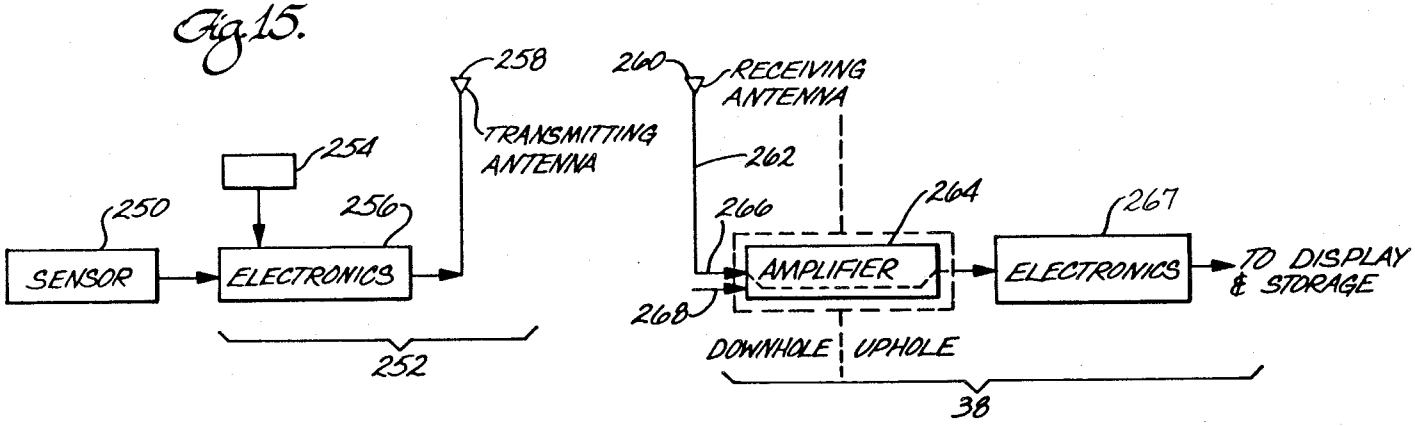
FIG. 15 is a schematic diagram of a sensor, transmitter, receiver and processing display and storage for use in the system of FIGS. 1, 2 and 3.

Refer now to FIG. 15 which depicts a schematic diagram of the over all system involved in detecting, providing and sending data signals representing a parameter from down hole to the top of the well bore. Sensor 250 senses the parameter, preferably pressure, and provides a data signal to transmitter 252. The transmitter 252 includes electronics 256 and a signal sender for sending signals into the annulus between the tubing string and the casing. The signal sender is generally referred to herein for ease of reference as transmitting antenna 258 for inducing potentials in the conductive fluid in the annulus. Also included is a power supply or battery 254 for providing power to the electronics 256 and if necessary to the sensor 250. To be explained in more detail the electronics 256 may take on a number of configurations, however, it is arranged for receiving data signals from the sensor 250 representing the sensed parameter and for producing data signals which can be sent by the transmitting antenna 258 to and received by a receiver. The sensor 250, transmitter 252 and battery 254 are always located down hole. A receiver, also referred to for convenience, as a receiving antenna 260, receives the data signals representative of the parameter which has been sent into the annulus by the transmitting antenna 258. In one embodiment a wire line 262 (with one or multiple conductors), conducts data signals representative of the parameter (represented by the received data signals) up hole to receiving electronics, display and storage apparatus 38 (see FIG. 1). Apparatus 38 includes amplifier 264 which amplifies the data signals from the wire line and receiving electronics 267, which processes the amplified signals into a form suitable for display and/or storage by means not shown in FIG. 15.

To be explained in the more detail the amplifier 264 may be divided up into two amplifier sections, a preamplifier section down hole at the lower end of the wire line near the receiving antenna 260 and an amplifier section up hole. The preamplifier section preamplifes the signals before they are conducted by the wire line up hole to the rest of the amplifier section. If the signal is preamplified before conduction up the wire line, the wire line must be a coaxial conductor, by way of example as shown in FIG. 4. Also, power can be provided over the wire line from the top of the wire line without adding additional conductors thus avoiding the need for batteries or other sources of power down at the receiver. It should also be noted that the amplifier will have two inputs indicated at 266 and 268. The input 266 may be connected to the insulated conductor in the wire line whereas the other input 268 may be connected to a shield (if present) or other conductor in or on the wire line, the upper end of the casing 24 at the top of the well or to one or more ground electrodes positioned in the ground around the well, depending on the configuration and design of the system. Where the receiving antenna receives potentials, the shield or other conductor of the wire line, the upper end of the casing or the ground electrodes connected to the second input 268 become a source of reference potentials or a reference with respect to which the signals at input 266 are detected. In the arrangement where the receiving antenna 260 is a magnetic pick-up, picking up magnetic signals, the inputs 266 and 268 will be effectively connected across the ends of the coil forming a part of the magnetic pick-up in the receiving antenna.

With the foregoing in mind it will be appreciated that if all sections of the amplifier 264 are contained at the top of the well, then the receiving antenna and everything at the bottom of the wire line will be passive and thus will minimize the amount of the electronics, the power required down hole and the outer size of the equipment lowered on the end of the wire line. If on the other hand portions of the amplifier or other electronics are located down hole at the lower end of the wire line, then the equipment at the receiving antenna is not passive and may require additional and larger equipment then with a passive arrangement.

Figure 16:
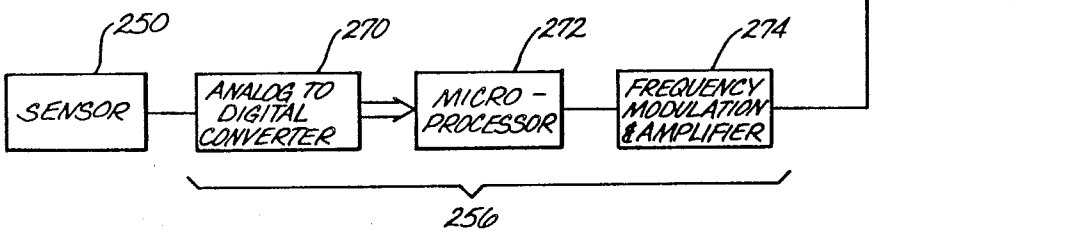
FIG. 16 is a schematic and block diagram depicting the sensor and details of a transmitter for forming digitally encoded frequency modulated carrier signals representing the parameter.

FIG. 16 shows a specific example of the electronics 256. Specifically the sensor provides an analog output whose amplitude is proportional to sensed pressure. Analog to digital convertor 270 converts the analog signal to digital coded signals for a micro-processor 272. The micro-processor 272 converts the digital signals into a serial and redundantly encoded bit string. The frequency modulation and amplifier unit 274 then transmits the serial bit string via transmitting antenna 258 into the annulus using a signal of one frequency to represent a binary 0 and a signal of a second frequency to represent a binary 1. The data signal is then sent by the transmitting antenna 258 into the annulus.

It should be understood that the frequency modulator and amplifier unit 274 may be replaced by other suitable means for forming signals that may be sent out into the annulus by antenna 258, such as circuits which produce amplitude modulated signals, phase modulated signals or other suitable signals for transmission by transmitting antenna 258.

The analog-to-digital convertor 270 may comprise any one of a number of convertors well known in the art, as may processor 272. Preferably the processor is a CMOS circuit and encodes the signals provided to frequency modulator and amplifier unit 274 to a form which allows error correction. Preferably the microprocessor 272 provides digital signals to the frequency modulator and amplifier unit 274 at the rate of 1 binary bit per second. A suitable carrier frequency is preferably as low as 10 to 20 hertz and as high as 10 kilohertz or higher.

Figure 17:
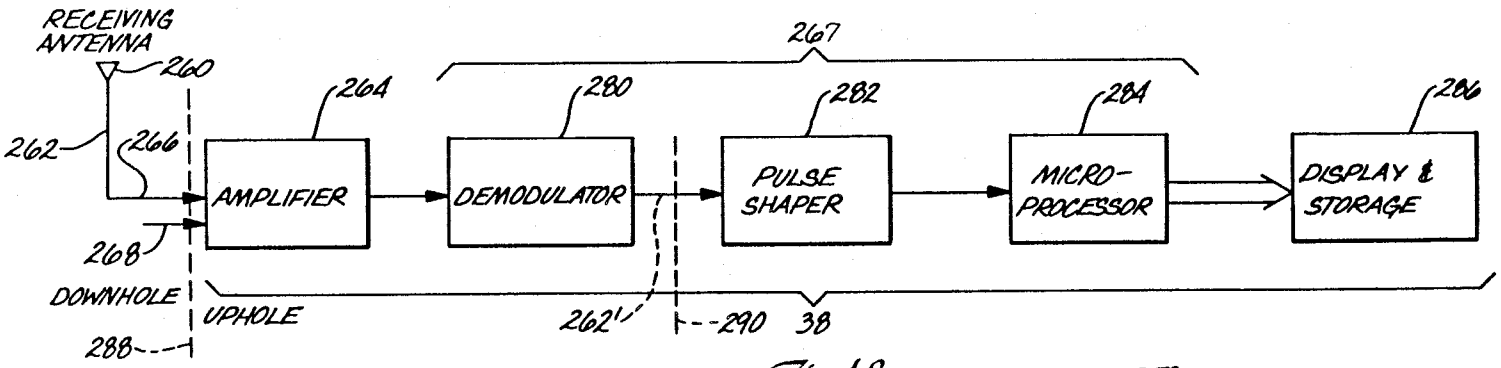
FIG. 17 provides a schematic and block diagram depicting the details of the processing display and storage for frequency modulated carrier signals received by the receiver of FIG. 15.

FIG. 17 depicts a specific embodiment of the receiving portion of FIG. 15 including the receiving antenna 260 and the receiving electronics, display and storage apparatus 38. Apparatus 38 includes amplifier 264, electronics 267, and a display and storage unit 286. The system of FIG. 17 is for receiving data signals represented by the frequency modulated signals produced by the system of FIG. 16. Specifically, receiving antenna 260 receives the frequency modulated data signals from the antenna 258 of FIG. 16. With a passive system the signals are conducted directly from the antenna 260 up the wire line 262 to amplifier 264 where the data signals are amplified. The demodulator 280 converts the amplified data signals from frequency modulated signals to digital signals representative of the parameter. Pulse-shaper 282 shapes the signals into a proper form for reading by micro-processor 284. Micro-processor 284 processes the digital signals into the proper form for display such as on a digital visual display and for storage such as on magnetic tape, disk or the like.

The system of FIG. 17 just discussed is passive, that is, none of the amplifier or other electronics, are located at the bottom of the wire line.

In another arrangement the amplifier 264 and demodulator 280 are located down hole at the receiving antenna as depicted to the left of dash line 290 and the pulse-shaper, microprocessor and display and storage are located up hole as indicated to the right of dash line 290. With this latter arrangement, wire line 262 would be replaced by a suitable electrical connector to amplifier 264 and the wire line would be positioned at 262' between the demodulator and the pulse-shaper. With this arrangement the signals will be of higher amplitude and therefore easier to detect at the top of the hole than if no amplifying is provided down hole.

Figure 18:
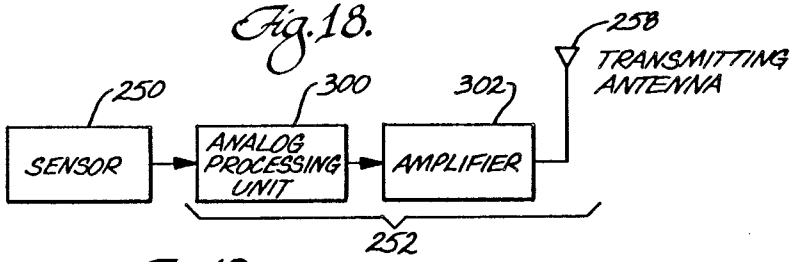
FIG. 18 is a schematic and block diagram depicting an alternate arrangement of the sensor and transmitter in which analog signals from the sensor are converted to frequency modulated signals for sending to the receiver.

FIG. 18 depicts a specific embodiment of the sensor electronics and transmitting antenna 258 shown to the left in FIG. 15 where the pressure parameter data signals are encoded in analog form. The analog output data signals from the sensor 250 representing the pressure parameter are processed by the analog processing unit 300 and converted to a frequency modulated signal, the frequency of which represents the analog signal and hence parameter. The frequency modulated signal is then amplified by amplifier 302 and then sent to the transmitting antenna 258 for sending data signals into the annulus for pick-up by the receiving antenna. The analog processing unit 300, by way of example operates on an analog signal from 0–5 volts and converts these signals to a frequency from 10–several thousand hertz, the actual frequency being proportional to the actual voltage level of the analog signal. Preferably the analog processing unit 300 alternates between the frequency representing the actual analog signal and a signal representing the full scale analog output for calibration purposes at the top of the well.

Figure 19:
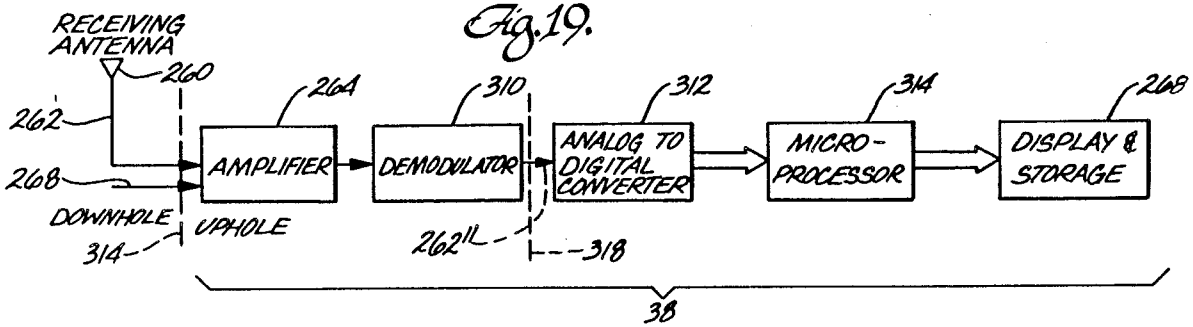
FIG. 19 depicts a receiver and processing, display and storage apparatus for use with the data signals provided by FIG. 18.

FIG. 19 depicts the receiving antenna 260 and the receiving electronics and display and storage apparatus 38 for use with the data signals formed by the transmitter of FIG. 18. Specifically, the data signals sent by antenna 258 of FIG. 18 are received by receiving antenna 260, signals corresponding thereto representing the sensed parameter are conducted up the wire line 262 to amplifier 264 which amplifies the signals and provides them to demodulator 310. Demodulator 310 converts the frequency modulated signals back to analog voltage signals in the range of between 0–5 volts, the magnitude of which represents the value of the parameter. Analog to digital convertor 312 converts the analog signals to digital form for the micro-processor 314. The micro-processor 314 does signal processing to remove errors from the signal and to convert the digital signals to a form which can be displayed and stored by a display and storage unit 268 in the manner discussed above.

With the arrangement just discussed, the down hole portion of the system at the receiving antenna 260 is passive. To this end the dash line 318 indicates that everything to the left is down hole whereas everything to the right is up hole. It may be desirable in some applications to locate the amplifier and demodulator down hole at the receiving antenna 260, in which case the portion to the left of dash line 318 will be down hole and the portion to the right will be up hole and the wire line will be at 262'' between the demodulator and the analog to digital convertor.

The digital system depicted in FIGS. 16 and 17 are potentially more accurate than the analog versions of FIGS. 18 and 19, since in the digital version error correcting encoding methods can be used to correct for the effects of noise in the transmission link.

The analog version depicted in FIGS. 18 and 19 has an advantage in that less down hole electronics are generally required in order to conduct the signals to the top of the well, making it easier to design for high temperatures. Additionally, less power is required down hole.

Figure 20:
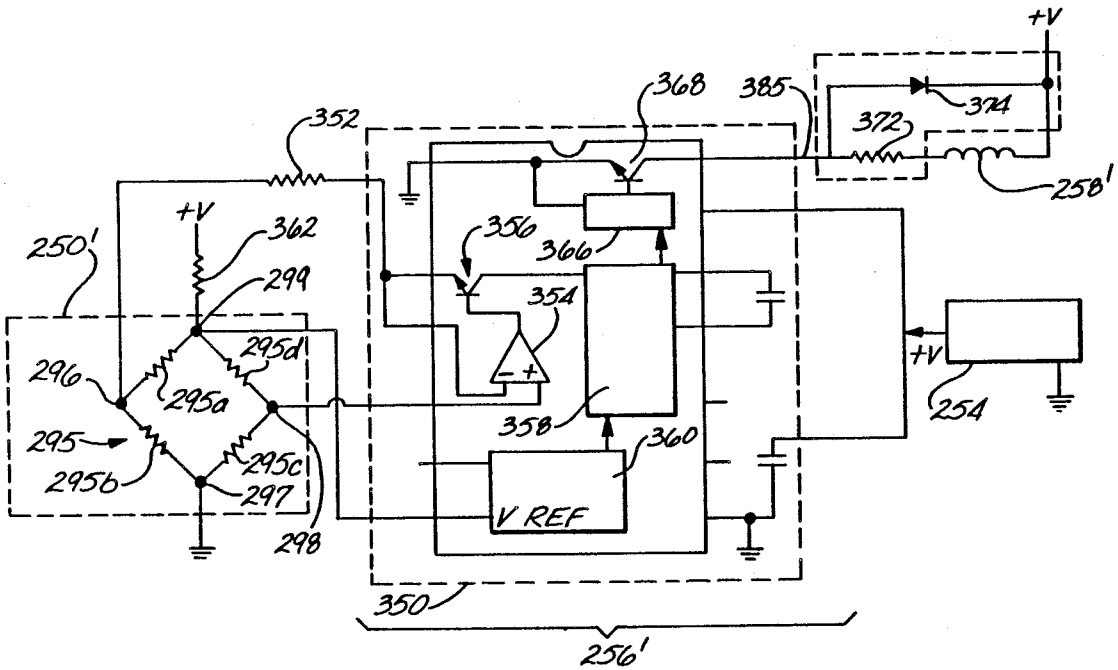
FIG. 20 is a detailed schematic diagram of the sensor and transmitter for forming electromagnetic fields for use in FIG. 15.

FIG. 20 depicts a specific example of the sensor, electronics and transmitting antenna of FIG. 15 which produces magnetic fields and electrical potentials in the annulus. Although the circuit of FIG. 20 forms electrical potentials in the conductive fluid for the electrode receiver, it is preferrably used to form magnetic signals for inductive type receivers where there is a close spacing between the transmitting antenna and the receiver.

Sensor 250' includes a balanced bridge circuit 295 having a conventional four terminal bridge with resistors 295*a*, 295*b*, 295*c* and 295*d*, each connected between a different pair of terminals. Terminal 297 is connected to the ground conductor for battery 254. Terminal 299 is connected through resistor 362 to the + V side of battery 254. Variable pressure sensitive resistor 295*a* is connected between the terminals 296 and 299, the resistance of resistor 295*a* varies as a function of pressure sensed by the sensor.

Electronics 256' preferably includes an integrated circuit chip 350 of the type AD 537 manufactured by Analog Devices of Norwood, Mass., which converts the analog signals from the pressure sensor to a frequency modulated carrier signal for application to the receiving antenna 258'. The chip 350 includes a voltage to frequency convertor 358, operational amplifier 354, and NPN transistor 356, a transistor driver 366, NPN transistor 368 and a source of reference voltage 360. The terminal 298 between resistors 295*c* and *d* of the bridge is coupled to the + input of amplifier 354. The terminal 296 between resistors 295*a* and *b* of the bridge is coupled through resistor 352 to the − input of amplifier 354. The output of amplifier 354 is connected to the base electrode of transistor 356. The emitter electrode of transistor 356 is coupled to the junction between resistor 352 and the − input of amplifier 354. The collector electrode of transistor 356 is connected to the control input of voltage to frequency convertor 358. Voltage to frequency convertor 358 provides a signal through driver circuit 366 to transistor 368 which signal has a frequency that is proportional to the current supplied through the collector of transistor 356. Battery 254 applies an output of approximately +6 volts potential at the + output. Resistor 362 is selected to cause a voltage of approximately +1 volts to occur at terminal 299 of the bridge. The internal reference generated at the output to convertor 358 by V reference 360 will be proportional to the signal at terminal 299. Preferably the resistor 362 is approximately 1750 OHMS with a pressure sensing resistor 295*a* value of approximately 350 OHMS. As a result a small amount of current is drawn from the voltage reference at terminal 299.

The output, at which the resultant frequency signals are formed by the convertor 358, is coupled through driver circuit 366 to the base electrode of transistor 368. The transistor 368 operates in a switching mode. The emitter electrode of transistor 368 is connected to ground, whereas collector electrode, of the transistor is connected by conductor 385 through a current limiting resistor 372 to one side of the coil in the transmitting antenna 258'. The opposite side of the coil of the transmitting antenna 258' is connected to the + V output of the battery 254. As a result the frequency modulated signals formed by the convertor 358 cause the transistor 368 to form signals in the coil of the transmitting antenna 258' causing it to form electromagnetic fields, which are picked up by the corresponding receiving antenna.

Diode 374 is connected in parallel with resistor 372 and the coil of transmitting antenna 258 and limits voltage at the collector of transistor 368 as well as provides a discharge path for current in coil 258' transistor 368 is switched off. Resistor 372 is a current limiting resistor in both the charge and discharge cycles and also sets the resistance inductance time constant. The battery 254 is preferably three high temperature lithium battery cells with unregulated voltage, but the voltage must be greater than 5 volts DC. With this arrangement the sensor electronics and transmitting antenna can be run directly from a battery type power supply 254 and the chip is relatively insensitive to supply voltage variations.

Figure 21:
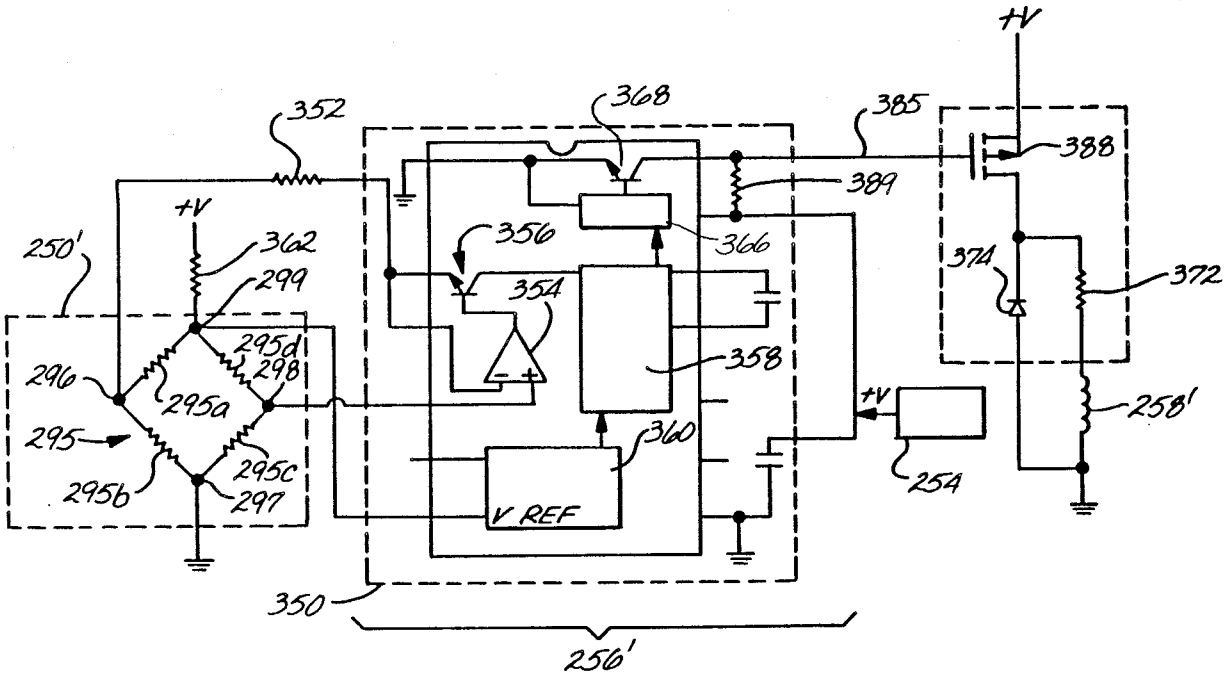
FIG. 21 is a schematic and block diagram similar to FIG. 20 modified to produce a stronger signal in the annulus.

The circuit of FIG. 21 is essentially the same as FIG. 20 except that it is modified to provide greater amplification to the signals being sent by the transmitting antenna and hence greater output power so that the signals can be transmitted over a larger separation between the transmitting antenna and the receiving antenna. In this regard a MOSFET transistor amplifier 388, is provided with its control electrode connected to output conductor 385 and its output electrodes connected between the + V output of battery 254 and the junction between diode 374 and resistor 372. The junction of diode 374 and the coil of the transmitting antenna 258' are connected to the ground conductor for the battery 254. In addition, a pull up resistor 389 is connected between the control electrode of transistor 368 and the + V output of the battery 254.

Where there is a closely spaced relation between the transmitter and receiver, the transmitter may transmit and the receiver may receive optical signals or acoustic signals.

Although a wire line, having one or more conductors for passing the data signals to the top of the well bore is the preferred form of the flexible line, it will be understood by those skilled in the art that a flexible line with fiber optic conductors may be used with appropriate means for conversion of the received data signals to optical form.

Also, if spacing between transmitter and receiver is sufficiently close, applications may be encountered where the optic or sonic wave signals may be transmitted by the transmitter and received by the receiver.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention.

What is claimed is:

1. A method for recovery of data signals representing a parameter from downhole up to the top of a well bore, having therein a conductive fluid, the data signals representing a parameter downhole in the well bore, the method comprising the steps of:

lowering an exposed electrode receiver down the well bore suspended at an end of a flexible line while the wire line extends to the top of the well bore;

receiving with the receiver from the conductive fluid digitally coded potentials representative of the parameter; and passing data signals representing the parameter represented by the received potentials over the line to the top of the well bore.

2. The method of claim 1 wherein the step of passing comprises the step of conducting the data signals up to the top of the well bore over at least one insulated conductor comprised by the line.

3. The method of claim 2 further comprising the steps of amplifying the data signals conducted by the at least one conductor at the top of the well bore.

4. The method of claim 2 comprising the step of preamplifying the data signals which are conducted up to the top of the well bore before they are conducted up to the top of the well.

5. The method of claim 2 wherein the wire line comprises a further conductor extending to the top of the well bore and comprising the step of forming the data signals, which are conducted to the top of the well bore, on the at least one conductor and the further conduction.

6. The method of claim 2 comprising the step of coupling the received potentials to the at least one conductor for conduction to the top of the well bore.

7. The method of claim 1 wherein the step of lowering comprises the step of lowering the receiver suspended on a wire line.

8. A method for recovery of data signals representing a parameter from downhole up to the top of a well bore, having therein a conductive fluid, the data signals representing a parameter downhole in the well bore, the method comprising the steps of:

lowering an exposed electrode receiver down the well bore suspended at an end of a flexible line while the wire line extends to the top of the well bore;

receiving with the receiver from the conductive fluid digitally coded potentials representative of the parameter; and passing data signals representing the parameter represented by the received potentials over the line to the top of the well bore, wherein the step of passing comprises the step of conducting the data signals up to the top of the well bore over at least one insulated conductor comprised by the line, and wherein the potentials received by the receiver are amplified and demodulated to produce data signals for conduction over the at least one conductor to the top of the well.

9. A method for recovery of data signals from down hole up to the top of a well bore having a conductive fluid, therein the data signals representing a parameter down hole in the well bore, the method comprising the steps of:

(a) lowering a sensor and a transmitter down hole inside of the well bore;

(b) lowering down hole inside of the well bore, separately from the sensor and transmitter, an exposed electrode receiver suspended at an end of a flexible line while the line extends to the top of the well bore;

(c) creating with the transmitter and receiving with the electrode receiver in conductive fluid in contact with the electrode receiver, electrical potentials representing a parameter sensed by the sensor; and (d) passing data signals representing the parameter represented by the received electrical potentials over the line to the top of the well bore.

10. The method of claim 9 wherein the step of passing comprises the step of conducting the data signals up to the top of the well bore over at least one insulated conductor comprised by the line.

11. The method of claim 10 further comprising the steps of amplifying the data signals, conducted over the at least one insulated conductor, at the top of the well bore.

12. The method of claim 10 comprising the step of preamplifying the data signals which are conducted up to the top of the well bore before they are conducted up to the top of the well bore.

13. The method of claim 10 wherein the potentials received by the receiver are amplified and demodulated to produce data signals for conduction over the at least one conductor to the top of the well bore.

14. The method of claim 10 wherein the line comprises a further conductor extending to the top of the well bore and comprising the step of forming the data signals, which are conducted to the top of the well bore, on the at least one conductor and the further conductor.

15. The method of claim 10 comprising the step of coupling the received potentials to the at least one conductor for conduction to the top of the well bore.

16. The method of claim 9 comprising the step of sensing pressure with the sensor.

17. The method of claim 9 wherein the transmitter comprises a coil and wherein the step of transmitting with the transmitter comprises the step of forming the potentials received by the receiver with the coil.

18. The method of claim 9 wherein the transmitter comprises an elongated conductive member and wherein the step of transmitting comprises the step of inducing currents along the length of the elongated member representative of the sensed parameter.

19. The method of claim 9 wherein the step of lowering the electrode receiver comprises the step of lowering the line with the receiver supported substantially only with the line.

20. The method of claim 9 wherein the step of transmitting comprises the step of inducing a current along a portion of a conductive member forming a tubing string in the well bore.

21. The method of claim 9 wherein the step of transmitting comprises the step of forming variable frequency potentials representative of the parameter.

22. The method of claim 9 wherein the step of transmitting comprises the step of transmitting digitally coded potentials representative of the parameter.

23. In combination with a well bore, having a conductive fluid therein, means for recovery of data signals from down hole up to the top of the well bore, the data signals representing a parameter down hole in the well bore, the means comprising:

(a) a sensor and a transmitter positioned down hole inside of the well bore; and (b) a receiver, separate from the sensor and transmitter, and a flexible line, the receiver being suspended at an end of the flexible line in the well bore, the line extending to the top of the well bore, the transmitter being adapted to form in and the receiver being adapted to receive from the conductive fluid, electrical potentials representing a parameter sensed by the sensor, the line being adapted for passing data signals representing the parameter represented by the potentials received by the receiver up to the top of the well bore.

24. The combination of claim 23 wherein the line comprises at least one insulated conductor for conducting the data signals to the top of the well bore.

25. The combination of claim 24 further comprising means for amplifying the data signal, conducted by the at least one insulated conductor, at the top of the well bore.

26. The combination of claim 24 comprising means for preamplifying the received data signals before conduction as data signals up to the top of the well bore on the at least one insulated conductor.

27. The combination of claim 24 comprising means for amplifying and demodulating the received potentials to produce the data signals for conduction over the at least one conductor to the top of the well bore.

28. The combination of claim 24 wherein the wire line comprises a further conductor extending to the top of the well bore, and wherein signals corresponding to those received by the receiver are conducted as data signals to the top of the well bore on the at least one insulated conductor and the further conductor.

29. The combination of claim 28 wherein the receiver comprises first and second spaced apart electrodes exposed to the conductive fluid for receiving the electrical potentials.

30. The combination of claim 29 wherein electrical potentials corresponding to those received on the first and second electrodes are formed between the at least one insulated conductor and the further conductor as the data signals for conduction to the top of the well bore.

31. The combination of claim 30 wherein the first and second spaced apart electrodes are arranged on the receiver so that, when in the well bore, one is at an up hole position on the receiver relative to the other.

32. The combination of claim 30 wherein the first and second spaced apart electrodes are arranged on the receiver so that when in the well bore they are in transverse positions relative to the longitudinal direction of the well bore.

33. The combination of claim 30 wherein the sensor is a pressure sensor.

34. The combination of claim 30 wherein the line is a wire line.

35. The combination of claim 24 wherein the received potentials are coupled to the at least one insulated conductor for conduction to the top of the well bore.

36. The combination of claim 24 wherein the line comprises a metal sheath and the receiver is mechanically connected to and supported by the metal sheath and is electrically coupled to the at least one insulated conductor.

37. The combination of claim 23 comprising a string of members in the well bore extending to the top of the well bore and wherein the sensor is mounted to a lower portion of the string of members for movement down the well bore.

38. The combination of claim 23 comprising a string of members in the well bore extending to the top of the well bore and wherein the sensor and transmitter are both mounted on a lower portion of the string of members for movement down the well bore.

39. The combination of claim 23 wherein the sensor and transmitter are mounted together in a single module for releasing and passing down the bore hole, due at least in part to the pull of gravity.

40. The combination of claim 23 wherein the transmitter comprises a coil for forming the potentials received by the receiver.

41. The combination of claim 23 wherein the transmitter comprises an elongated conductive member and the transmitter is adapted for inducing currents along the length of the elongated member representative of the sensed parameter.

42. The combination of claim 23 wherein the line is substantially the only support for the receiver.

43. The combination of claim 23 wherein the transmitter comprises means for forming variable frequency data signals representative of the parameter.

44. The combination of claim 23 wherein the transmitter comprises means for forming digitally coded data signals representing the parameters.

45. The combination of claim 23 wherein the electrode receiver comprises an elongated electrode.

46. The combination of claim 45 wherein the electrode receiver has substantially the same size outer periphery as said line.

47. The combination of claim 45 wherein the electrode receiver is substantially 3 feet in length or longer.

48. The combination of claim 45 wherein the electrode receiver comprises a cylindrical shaped member.

49. The combination of claim 48 wherein the diameter of the cylindrical shaped member is substantially 0.5 inches.

50. Means for recovery of data signals from down hole up to the top of the well bore, the data signals representing a parameter down hole in the well bore, the means comprising:

(a) a sensor and a transmitter positioned down hole inside of the well bore; and (b) a receiver, separate from the sensor and transmitter, and a wire line having at least one insulated conductor and a metal sheath therearound, the receiver being mounted for suspension at an end of the wire line from the metal sheath, the transmitter being adapted to form in and the receiver being adapted to receive from the conductive fluid, electrical potentials representing a parameter sensed by the sensor, the wire line being adapted for passing data signals representing the parameter represented by the potentials received by the receiver over the at least one insulated conductor up to the top of the well bore.

* * * * *

UNITED STATES PATENT AND TRADEMARK OFFICE

CERTIFICATE OF CORRECTION

PATENT NO. : 4,770,034

DATED : September 13, 1988

INVENTOR(S) : Titchener et al.

It is certified that error appears in the above-identified patent and that said Letters Patent is hereby corrected as shown below:

In the Specification

Column 1, line 20, change "2987" to -- 1987 --.

Column 2, line 51, change "inches" to -- inch --.

Column 3, line 31, change "flexbile" to -- flexible --.

Column 4, line 5, before "positioned" delete -- is --.
Column 4, line 23, after "FIG." insert -- 2 --.
Column 4, line 26, before "located" delete -- is --.

Column 7, line 11, after "bottom" change "ot" to -- of --.
Column 7, line 43, after "wound" insert -- on --.
Column 7, line 61, before "receiver" delete -- the -- (second occurrence).

Column 8 , line 13, after "36a" insert a period.
Column 8, line 42, change "inches" to -- inch --.

Column 9, line 5, before "electrode" delete -- with -- (second occurrence).
Column 9, line 53, after "30'" insert -- mounted --.
Column 9, line 57, after "48," insert -- with --.
Column 9, line 58, delete "is".
Column 9, line 68, before "voltage" delete "an".

Column 10, line 46, change "ocausing" to -- causing --.

Column 11, line 5, change "respectfully" to -- respectively -.
Column 11, line 21, change "respectfully" to -- respectively --.

UNITED STATES PATENT AND TRADEMARK OFFICE

CERTIFICATE OF CORRECTION

PATENT NO. : 4,770,034

DATED : September 13, 1988

INVENTOR(S) : Titchener et al.

It is certified that error appears in the above-identified patent and that said Letters Patent is hereby corrected as shown below:

Column 11, line 29, after "133" insert -- and --.
Column 11, line 38, change "interv" to -- intervening --.
Column 11 line 43, change "herei" to -- herein --.
Column 11, lines 55, 56, change "conduct" to -- conductive --.
Column 11, line 68, change "sleeve" to -- member --.

Column 13, line 25, change "over all" to -- overall --.

Column 14, line 33, change "then" to -- than --.

Column 16, line 31, change "preferrably" to -- preferably --.

Column 17, line 29, after "coil 258'" insert -- when --.

<u>In the Claims</u>

Column 18, line 15, change "downhole" to -- down hole --.
Column 18, lines 51 & 52, change "downhole" to -- down hole -.
Column 22, line 18, change "inches" to --inch--.

Signed and Sealed this

Eighteenth Day of April, 1989

*Attest:*

*Attesting Officer*

DONALD J. QUIGG

*Commissioner of Patents and Trademarks*